US008409508B2

(12) United States Patent
Ririe et al.

(10) Patent No.: US 8,409,508 B2
(45) Date of Patent: Apr. 2, 2013

(54) SAMPLE WITHDRAWAL AND DISPENSING DEVICE

(75) Inventors: Kirk Max Ririe, Salt Lake City, UT (US); Brent Farnes Higginson, Blackfoot, ID (US); Abigail Bird, Salt Lake City, UT (US)

(73) Assignee: BioFire Diagnostics, Inc., Salt Lake City, UT (US)

( * ) Notice: Subject to any disclaimer, the term of this patent is extended or adjusted under 35 U.S.C. 154(b) by 1906 days.

(21) Appl. No.: 10/512,255

(22) PCT Filed: Apr. 23, 2003

(86) PCT No.: PCT/US03/12688

§ 371 (c)(1), (2), (4) Date: Oct. 21, 2004

(87) PCT Pub. No.: WO2004/004904

PCT Pub. Date: Jan. 15, 2004

(65) Prior Publication Data

US 2005/0226772 A1 Oct. 13, 2005

Related U.S. Application Data

(60) Provisional application No. 60/374,730, filed on Apr. 23, 2002.

(51) Int. Cl.
*B01L 9/00* (2006.01)

(52) U.S. Cl. ..... 422/68.1

(58) Field of Classification Search ..... 422/102, 422/68.1

See application file for complete search history.

(56) References Cited

U.S. PATENT DOCUMENTS

| | | | | | |
|---|---|---|---|---|---|
| 1,984,610 | A | * | 12/1934 | Warren | 222/105 |
| 3,547,780 | A | * | 12/1970 | Finnerty, Jr. et al. | 435/37 |
| 3,873,271 | A | | 3/1975 | Young et al. | |
| 3,939,887 | A | * | 2/1976 | Scarnato | 220/666 |
| 4,142,645 | A | * | 3/1979 | Walton | 215/260 |
| 4,327,746 | A | | 5/1982 | Feaster | |
| 4,415,085 | A | * | 11/1983 | Clarke et al. | 206/526 |
| 4,876,788 | A | * | 10/1989 | Steer et al. | 29/508 |
| 4,925,055 | A | * | 5/1990 | Robbins et al. | 220/495.06 |
| 4,999,307 | A | * | 3/1991 | Oakley | 436/180 |
| 5,097,842 | A | * | 3/1992 | Bonn | 600/575 |
| 5,108,603 | A | | 4/1992 | Schuette | |
| 5,309,924 | A | * | 5/1994 | Peabody | 600/578 |
| 5,312,379 | A | * | 5/1994 | Rahe | 604/318 |

(Continued)

FOREIGN PATENT DOCUMENTS

| | | | |
|---|---|---|---|
| WO | WO-95/21382 | A | 8/1995 |
| WO | WO 03/007677 | A2 | 1/2003 |

OTHER PUBLICATIONS

The definition of "vacuum" from Merriam-Webster's Online Dictionary. Date: May 13, 2010.*

(Continued)

*Primary Examiner* — Bobby Ramdhanie
*Assistant Examiner* — Denise R Anderson
(74) *Attorney, Agent, or Firm* — Maginot, Moore & Beck, LLP

(57) ABSTRACT

A device is provided for receiving a fluid sample. The device includes a fitment having a cavity formed therein. The cavity is provided under vacuum. The fitment also includes a port having a seal. The port is configured to provide fluid connection from an exterior surface of the fitment to the cavity upon opening of the seal. The device optionally includes a collapsible compartment coupled to the fitment and in fluid communication with the cavity.

28 Claims, 11 Drawing Sheets

U.S. PATENT DOCUMENTS

| | | | | |
|---|---|---|---|---|
| 5,741,708 | A | 4/1998 | Carey et al. | |
| 5,855,626 | A * | 1/1999 | Wiegner et al. | 8/406 |
| 5,863,502 | A | 1/1999 | Southgate et al. | |
| 6,716,200 | B2 * | 4/2004 | Bracken et al. | 604/265 |
| 2001/0029794 | A1 | 10/2001 | Frye et al. | |
| 2002/0068357 | A1 | 6/2002 | Mathies et al. | |
| 2002/0086417 | A1 * | 7/2002 | Chen | 435/287.3 |
| 2003/0022177 | A1 | 1/2003 | Wittwer et al. | |

OTHER PUBLICATIONS

Idaho Technology Inc., LightCycler® Users Guide Model: LC 32, 1997-2001.

* cited by examiner 10
12
14
16
18
20
22
24
26
28
30
34
36
38
40
42
44
46
48
50
52
56

SAMPLE WITHDRAWAL AND DISPENSING DEVICE

CROSS-REFERENCE TO RELATED APPLICATIONS

This application is a U.S. national counterpart application of international application serial no. PCT/US2003/12688 filed Apr. 23, 2003, which claims the benefit of United States provisional application Ser. No. 60/374,730 filed Apr. 23, 2002.

BACKGROUND AND SUMMARY OF THE INVENTION

The process of performing a chemical or biochemical analysis on a sample often involves a series of manual measuring and transfer motions, for example opening a container, dispensing the reagent solution, drawing a predefined amount of sample from the specimen, and so on. Serial manual volumetric measurements, multiple dispensing actions, and multiple opening and closing of containers are potential points of human error, contamination, and in some case, health risk. These potential problems are particularly acute for sample collection and analysis that need to occur outside of the controlled environment of the laboratory, such as, for example the collection of environmental samples for the detection of pathogens, infectious organisms, toxins, and bio-terrorism agents, as well as of forensic samples for the detection of human identifiers carried in the DNA, and the like.

In the field of clinical diagnostics, some of these concerns are addressed by the use of air evacuated tubes, such as VACUTAINER® tubes (Becton Dickinson and Company, of Rutherford, N.J.), for the collection of blood samples. These air evacuated tubes have needle penetrable stoppers inserted therein, and prevent the blood samples from becoming contaminated. The volume of blood to be withdrawn is controlled by the amount of vacuum in the tube, usually adjusted to partially fill the tube with blood. Evacuated glass vials prepackaged with reagents are described in U.S. Pat. No. 3,873,271, which also describes admitting a sample inside the evacuated vial by a cannula mounted in a special receptacle adapted to receive the vial. The use of one or more vacuum containers, or test tubes, to withdraw sample from a single syringe is described in U.S. Pat. No. 5,097,842. Further, in clinical diagnostics, robotics and automation are applied to withdraw blood samples from VACUTAINER® or other air evacuated containers, and dispense predetermined amounts of blood into reaction mixtures for analysis. These automation devices are often fairly large and may be unwieldy for sample collection and analysis outside of the laboratory.

According to one aspect of the present disclosure, a device for receiving a fluid is provided. The device includes a fitment and a collapsible compartment coupled to the fitment. The collapsible compartment is in fluid communication with the fitment. The fitment includes a cavity formed therein, and the cavity provided under vacuum. The fitment also includes a port having a seal. The port is configured to provide fluid communication from an exterior surface of the fitment to the cavity upon opening of the seal.

Illustratively according to this aspect of the disclosure, the cavity of the device is provided with a predetermined volume and a predetermined level of vacuum to receive a predetermined volume of the fluid upon opening of the seal. The device further includes a plunger sized to be received within the cavity. Activation of the plunger forces the predetermined volume of the fluid into the collapsible compartment.

Further illustratively, the plunger includes a notch configured to provide fluid communication between the cavity and the port when the notch is adjacent the port. The plunger acts to prevent fluid communication between the cavity and the port when the notch is rotated away from the port.

Additionally illustratively, the device further includes a dried reagent which may be contained within the collapsible compartment, the cavity, or both the collapsible compartment and the cavity. The dried reagent contained within the cavity may be the same as or different from the dried reagent contained within the compartment.

According to another aspect of the disclosure, a device for receiving a fluid is provided. The device includes a fitment having a plurality of cavities formed therein. Each cavity is provided under vacuum. The fitment further includes a channel fluidly connecting the cavities, a port extending from the channel to a surface of the fitment, and a seal provided at the port. The seal is configured to maintain vacuum in the cavities.

Illustratively according to this aspect of the disclosure, the seal may be breakable or the seal may be a unidirectional valve.

Further illustratively, the cavities are provided with a predetermined volume and a predetermined amount of vacuum such that upon opening the seal a predetermined volume of the fluid is drawn into each of the cavities. The device further includes means for sealing the fluid in each of the cavities.

Additionally illustratively, the device includes a plurality of collapsible compartments affixed to the fitment. Each collapsible compartment is in fluid communication with its respective cavity.

Further illustratively, the fitment further includes a plurality of additional cavities formed therein. Each additional cavity is provided under vacuum. The fitment further includes an additional channel fluidly connecting the additional cavities, an additional port extending from each additional channel to the surface of the fitment, and an additional seal provided at each additional port. The additional seal is configured to maintain vacuum in the additional cavities. The device further includes an additional plurality of collapsible compartments affixed to the fitment.

Each additional collapsible compartment is in fluid communication with its respective additional cavity.

Illustratively, the device further includes a plurality of plungers. Each plunger is sized to be received within its respective cavity. Activation of one of the plungers forces fluid received in the respective cavity into the collapsible compartment.

Further illustratively, a removable comb of the device may be provided to engage the plungers and normally prevent activation of the plungers.

Additionally illustratively, the channel of the fitment may be etched into the surface of the fitment and covered with a barrier material.

Further illustratively, the seal of the fitment includes a punctureable portion of the barrier material.

The plurality of cavities may form a row of cavities and the fitment may further include a plurality of additional rows of cavities. Each additional cavity is provided under vacuum. The fitment may further include a plurality of additional channels and a plurality of additional ports. Each additional channel connects the cavities of a respective row of cavities. Each additional port extends from a respective channel to the surface of the fitment. The fitment further includes a plurality of additional seals. Each seal is provided at its respective port and each additional seal is configured to maintain vacuum in its respective row of additional cavities. A removable cover may be provided to cover each cavity for maintaining vacuum within the cavities. Removal of the cover exposes the cavities to surrounding atmosphere.

According to yet another aspect of the present disclosure, a device for receiving a fluid sample includes a fitment and a flexible compartment coupled to the fitment. The fitment includes a vacuum chamber configured to maintain a vacuum therein and receive the fluid sample therein, a port in communication with the vacuum chamber and configured to receive the fluid sample therethrough, and a seal blocking the port. The flexible compartment is formed to define an interior region in fluid communication with the vacuum chamber. The flexible compartment is configured to receive the fluid sample therein.

According to this aspect of the present disclosure, the seal of the fitment is frangible. Further, the fitment is made of a generally non-compressible polymer material. The flexible compartment is made of a polymer.

According to another aspect of this disclosure, the device further includes a plunger received within the vacuum chamber and movable within the vacuum chamber to adjust a volume of open space unoccupied by the plunger within the vacuum chamber. The illustrative plunger includes a first end having a notch formed therein for alignment with the port of the fitment.

According to still another illustrative aspect of this disclosure, the fitment further includes a second port in communication with the vacuum chamber and configured to communicate with the surrounding atmosphere.

According to another aspect of the present disclosure, a device is configured to maintain an air-evacuated space therein and is provided for drawing a fluid sample into the air-evacuated space. The device includes a fitment and a flexible compartment coupled to the fitment. The fitment includes a vacuum chamber configured to maintain a vacuum therein, a first passageway in communication with the vacuum chamber and configured to communicate with the surrounding atmosphere, a second passageway in communication with the vacuum chamber and configured to communicate with the surrounding atmosphere, and a frangible seal positioned to block the second passageway to prevent communication between the vacuum chamber and the surrounding atmosphere. The flexible compartment of the device is formed to define an interior region configured to receive the fluid sample therein. The interior region is positioned in fluid communication with the vacuum chamber. The device further includes a plunger received within the vacuum chamber for up and down movement within the vacuum chamber to adjust a volume of open space unoccupied by the plunger within the vacuum chamber.

According this aspect of the disclosure, the plunger includes a notch for alignment with the second passageway of the fitment. The illustrative plunger is movable between a first position to block communication between the vacuum chamber and the first passageway and a second position to block communication between the vacuum chamber and the second port.

Further illustratively according to this aspect of the disclosure, the first passageway is less than 1 mm in diameter, the second passageway is less than 1 mm in diameter, and the vacuum chamber is 5 mm in diameter.

Additionally illustratively according to this aspect of the disclosure, the flexible compartment is made of a polyvinyl material. The fitment is made of a soft polymer plastic material and the plunger is made of a rigid polymer plastic material. Further, a diameter of the plunger is substantially equal to a diameter of the vacuum chamber.

Further illustratively according to this aspect of the disclosure, the air-evacuated space has a predetermined volume and is provided with a predetermined level of vacuum for drawing in a predetermined volume of the fluid sample.

According to yet another aspect of the disclosure, a pouch assembly for receiving multiple fluid samples therein is provided. The pouch assembly includes a fitment and a plurality of flexible compartments coupled to the fitment. The fitment includes a plurality of vacuum chambers formed therein, a sample access port in communication with at least one of the plurality of vacuum chambers, and a plurality of vacuum holes. Each vacuum hole is in fluid communication with one of the plurality of vacuum chambers. Each flexible compartment of the plurality of compartments is in fluid communication with one of the plurality of vacuum chambers.

Illustratively according to this aspect of the disclosure, the sample access port is in communication with each of the plurality of vacuum chambers. The fitment further includes a passageway between the sample entry port and each of the plurality of vacuum chambers. Further illustratively, the sample access port is a plurality of sample access ports and further each sample access port is in fluid communication with one of the plurality of vacuum chambers.

Still according to another aspect of the disclosure, a method of introducing a pre-measured amount of a fluid sample into a pouch assembly is provided. The pouch assembly includes a flexible compartment and a fitment coupled to the flexible compartment. The fitment includes a vacuum-evacuated cavity in fluid communication with the flexible compartment. The method includes breaking a seal of the fitment to provide communication between the vacuum evacuated cavity and the fluid sample, allowing the fluid sample to be drawn into the cavity, and moving the fluid sample from the cavity into the flexible compartment.

Illustratively according to this aspect of the present disclosure, moving the fluid sample from the cavity into the flexible compartment includes moving a plunger positioned within the cavity to push the fluid sample from the cavity into the flexible compartment.

Further illustratively according to this aspect of the present disclosure, the method further includes the step of creating a vacuum in the cavity by placing the pouch assembly in a vacuum chamber and evacuating air from within pouch assembly through a vacuum port of the fitment. The vacuum port is in communication with the cavity. Further, the step of creating the vacuum occurs prior to the step of breaking the seal. Still further, the step of creating the vacuum further includes plugging the vacuum port once the vacuum within the cavity is approximately 7 Pa. The step of creating the vacuum further includes plugging the vacuum port by moving a plunger of the pouch assembly within the cavity to block communication between the vacuum port and the cavity. The step of creating the vacuum may further illustratively include moving a plunger of the pouch assembly within the cavity to adjust a volume of open space of the cavity unoccupied by the plunger.

According to still another aspect of the present disclosure, a method of manufacturing a pouch assembly including a flexible compartment and a fitment coupled to the flexible compartment for receiving a predetermined amount of fluid sample therein is provided. The method includes molding the fitment of the pouch assembly from a polymer plastics material to include a vacuum cavity, etching a plurality of channels into a first surface of the fitment for communication with the vacuum cavity of the fitment, and coupling a flexible compartment of the pouch assembly to the fitment. The flexible compartment is in fluid communication with the vacuum cavity.

Illustratively according to this aspect of the disclosure, the coupling step includes coupling a top layer of the flexible compartment to the first surface of the fitment to cover the plurality of channels etched into the first surface and coupling a bottom layer of the flexible compartment to a second surface of the fitment to cover an aperture of the cavity formed therein. Further illustratively, coupling the top layer of the flexible compartment includes heat sealing the top layer to the first surface; coupling the bottom layer of the flexible compartment includes heat sealing the bottom layer to the second surface of the fitment.

Additional features of the present invention will become apparent to those skilled in the art upon consideration of the following detailed description of preferred embodiments exemplifying the best mode of carrying out the invention as presently perceived.

BRIEF DESCRIPTION OF THE DRAWINGS

A more particular description of the invention briefly described above will be rendered by reference to specific embodiments thereof which are illustrated in the appended drawings. These drawings depict only typical embodiments of the invention and are not therefore to be considered to be limiting of its scope. The invention will be described and explained with additional specificity and detail through the use of the accompanying drawings.

FIG. 2A is a diagrammatic sectional view of the pouch assembly showing the plunger in a first position to allow air from within the pouch assembly to be evacuated through a vacuum port of the fitment.

FIG. 2B is a diagrammatic sectional view of the pouch assembly showing the plunger having been lowered to a second position within the cavity to seal the vacuum port of the fitment to adjust a volume of open space within the cavity unoccupied by the plunger.

FIG. 2C is a diagrammatic sectional view of the pouch assembly showing a fluid sample contained within the evacuated cavity of the fitment after having been introduced into the evacuated cavity through a sample entry port of the fitment, and also showing a seal of the fitment having been broken to allow the fluid sample to be introduced into the evacuated cavity.

FIG. 2D is a diagrammatic sectional view of the pouch assembly showing the plunger having been rotated approximately 90 degrees to block the sample entry channel of the fitment.

FIG. 2E is a diagrammatic sectional view of the pouch assembly showing the plunger having been lowered to a third position within the cavity of the fitment to force the fluid sample within the cavity into the collapsible compartment.

DETAILED DESCRIPTION

The presently preferred embodiments will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in the figures, is not intended to limit the scope of the invention, as claimed, but is merely representative of presently preferred embodiments of the invention.

Figure 1A:
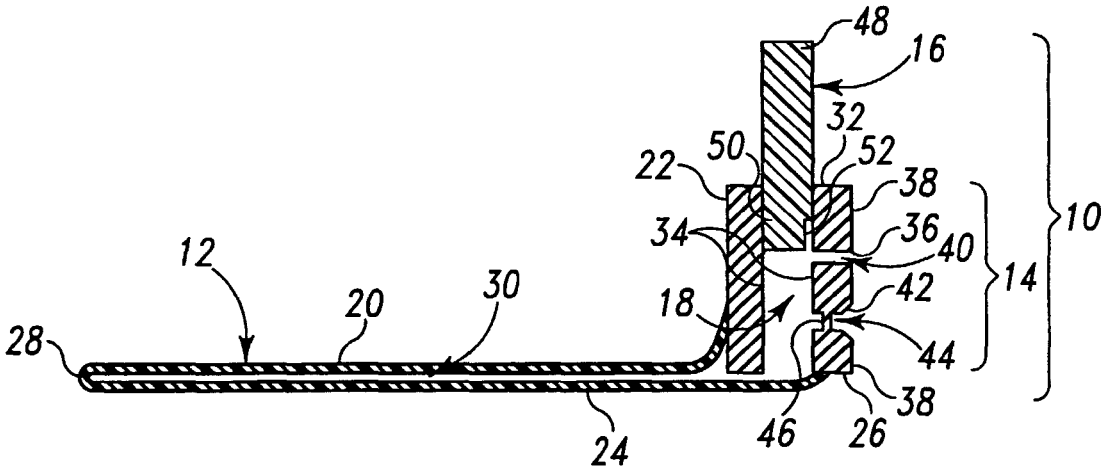
FIG. 1A is a diagrammatic sectional view of a single-compartment pouch assembly of the present disclosure showing the pouch assembly including a collapsible compartment, a fitment coupled to the collapsible compartment, and a plunger received within a cavity formed in the fitment.
Figure 1B:
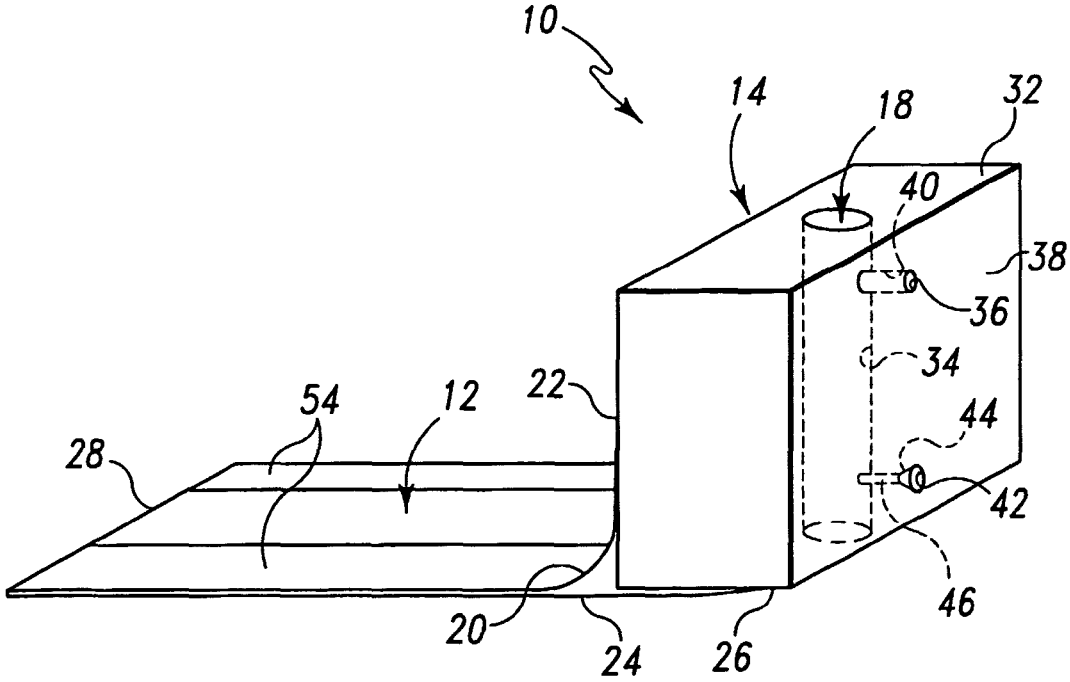
FIG. 1B is a perspective view of a portion of the pouch assembly of FIG. 1A showing the collapsible compartment and the fitment coupled to the collapsible compartment.
Figures 2A, 2B, 2C, 2D, 2E:
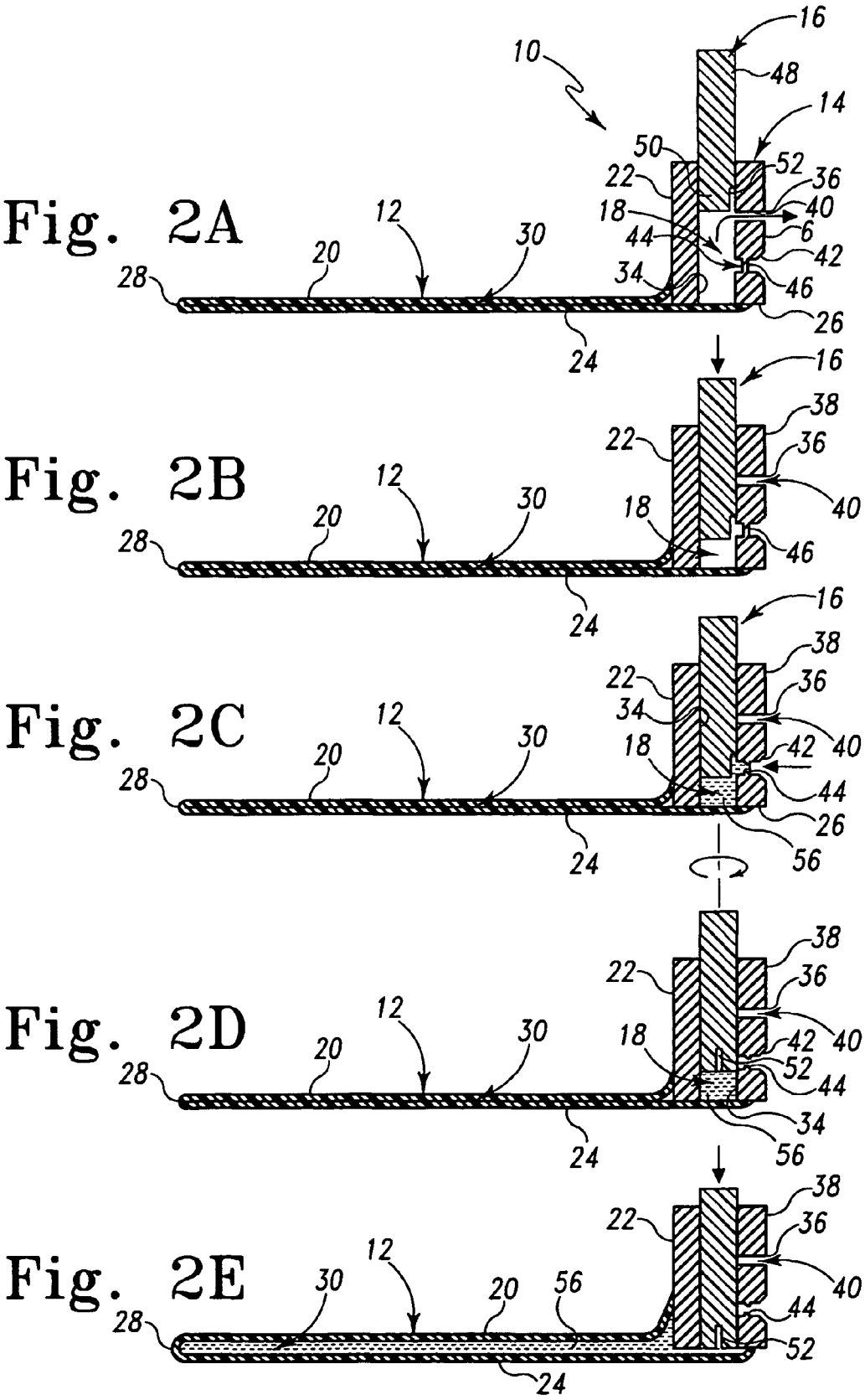
FIGS. 2A-2E are diagrammatic sectional views of the pouch assembly of FIGS. 1A and 1B showing air evacuation of the pouch assembly to create a vacuum therein and further showing a fluid sample being received within the pouch assembly.

A pouch assembly 10, shown in FIGS. 1A and 1B, is provided for receiving a fluid sample 56 (shown in FIGS. 2C-2E). Illustrative pouch assembly 10 includes a collapsible compartment 12, a fitment 14 coupled to the collapsible compartment 12, and a plunger 16 received within a cavity 18 of the fitment 14. As shown in FIG. 1A, collapsible compartment 12 includes a top layer 20 coupled to a front surface 22 of the fitment 14 and a bottom layer 24 coupled to a portion of a bottom surface 26 of the fitment 14. Illustratively, top and bottom layers 20, 24 are formed of a barrier material (defined below) which has been folded in half to create a bottom or end 28 of compartment 12 as well as top and bottom layers 20, 24 of compartment 12. Top and bottom layers 20, 24 are coupled to each other, as is discussed in greater detail below, to form compartment 12 having an interior region 30 for receiving fluid samples therein, for example.

The fitment 14, as mentioned above, includes cavity 18. Cavity 18 is in communication with interior region 30 of compartment 12 as shown in FIG. 1A. Illustrative cavity 18 of fitment 14 is cylindrical in shape and is formed to extend from a top surface 32 of fitment 14 to bottom surface 26. Illustrative cavity 18 is defined by an interior surface 34 of fitment 14 and has a diameter of approximately 5 mm; however, it is within the scope of this disclosure to include a cavity having other suitable diameters. For example, the cavity diameter may vary depending upon the volume of sample fluid desired to be deposited within each compartment. A diameter of a corresponding plunger 16 for use within cavity 18 may approximately the same or slightly larger than the cavity diameter in order to maintain a tight seal to provide a press-fit or interference-fit with the cavity 18. Illustratively plunger 16 is sized to slide within cavity 18 with a force of between approximately 1 to 20 N.

A vacuum port 36 of fitment 14 is formed through a rear surface 38 of fitment 14 to communicate with cavity 18 along a channel 40. Illustrative port 36 is approximately 2 mm in diameter; however, it is within the scope of this disclosure to include a vacuum port having other suitable diameters. As is discussed in more detail below, vacuum port 36 is provided for communication with a vacuum or vacuum chamber (not shown) to draw out the air from within pouch assembly 10 to create a vacuum within cavity 18 and interior region 30 of compartment 12.

Illustrative fitment 14 further includes a sample entry port 42 formed in the rear surface 38 of fitment 14. Illustratively, sample entry port 42 is positioned below vacuum port 36, as shown in FIGS. 1A and 1B. A channel 44 of fitment 14 is formed between cavity 18 and sample entry port 42. A seal 46 of fitment 14 is positioned within channel 44 to normally prevent communication between cavity 18 and the surrounding atmosphere via channel 44 and sample entry port 42.

As is discussed in greater detail below, seal 46 is frangible and may be broken upon insertion of a cannula (not shown), for example, through sample entry port 42 in order to allow a fluid sample from within the cannula to be drawn into cavity 18. Illustrative seal 46 is made of the same material as fitment 14. However, it is within the scope of this disclosure for the seal to be made of other suitable materials, such as, rubber, thin plastic film, and other elastomers, for example. Further, it is within scope of this disclosure for the seal to be positioned anywhere along channel 44 or within cavity 18, or covering port 42 to block communication between the cavity 18 and the surrounding atmosphere. In other words, port 42 is essentially a sealed port. Illustratively, sample entry port 42 is approximately equal to or less than 1 mm in diameter and channel 44 is similarly approximately equal to or less than 1 mm in diameter. However, it is within the scope of this disclosure to include a sample entry port and connecting channel having other suitable dimensions.

The illustrative plunger 16 of the pouch assembly 10 is cylindrical in shape and has a diameter of approximately 5 mm to be press-fit into cavity 18. Plunger 16 includes a first end portion 48 and an opposite second end portion 50. A notch 52 of plunger 16 is formed in second end portion 50, as shown in FIGS. 1A and 2A-2E, for example. In use, second end portion 50 is inserted into cavity 18 at top surface 32 of fitment 14. As is discussed in more detail below, notch 52 may be aligned with sample entry port 42 to allow a fluid sample to be drawn into cavity 18, as shown in FIG. 2C.

In describing the invention, the following terminology will be used in accordance with the definitions set forth below.

As used herein, the term "barrier material" refers to the flexible material from which the collapsible compartment 12 of the pouch assembly 10 is illustratively constructed. The barrier material potentially may be a single layer or a laminated structure, and, depending on the application, is preferably air and water impermeable. Other characteristics of the barrier material are dictated by the conditions of storage prior to use, the conditions during use, the nature of material that is to be contained in the collapsible compartment 12, and the nature of reaction and interrogation that is to be performed on the contained material. For instance, if the reaction is to be monitored optically, then at least a portion of the barrier material should be optically clear to the excitation and emission wavelengths used. If PCR is to be used, the barrier material should be able to withstand temperature cycling. Exemplary barrier materials include, but are not limited to, polyester, polyethylene terephthalate (PET), polycarbonate, polypropylene, polymethylmethacrylate, and mixtures thereof, and can be made by any process known in the art, including extrusion, plasma deposition, and lamination. Metal foils or plastics with aluminum lamination also may be used. Other barrier materials are known in the art. In an illustrated embodiment, for use with PCR, the collapsible compartment has a coefficient of heat transfer of approximately 0.02 to 20 W/m*degK.

If fluorescence monitoring of a reaction is desired, plastic films that are adequately low in absorbance and auto-fluorescence at the operative wavelengths are preferred. Such material could be identified by trying different plastics, different plasticizers, and composite ratios, as well as different thicknesses of the film. For plastics with aluminum or other foil lamination, the portion of the collapsible compartment 12 that is to be read by a fluorescence detection device can be left without the foil. For example, if fluorescence is monitored through the bottom 28 of pouch assembly 10, then bottom 28 would be left without the foil. In the example of PCR, film laminates composed of polyester (Mylar, Dupont, Wilmington Del.) of about 0.0048 inch (0.1219 mm) thick and polypropylene films of 0.001-0.003 inch (0.025-0.076 mm) thick perform well. Illustratively, each layer 20, 24 of collapsible compartment 12 is made of a clear material so that the collapsible compartment 12 is capable of transmitting approximately 80%-90% of incident light.

The term "flexible" is herein used to describe a physical characteristic of the barrier material of the collapsible compartment 12. The term "flexible" is herein defined as readily deformable and collapsible by the levels of vacuum used without cracking, breaking, crazing or the like, and readily returned essentially to the non-collapsed state with ease. For example, thin plastic sheets, such as Saran wrap and Ziplock bags, as well as thin metal foil, such as aluminum foil are flexible. Standard thin glass capillaries with outer diameter of about 1 mm may flex with attempts to bend, however, they are not flexible within the above-referenced definition.

The term "vacuum" refers to a pressure below atmospheric pressure. In illustrative examples of vacuum of 240 Pa or less or 7 Pa or less is used. However, other levels of reduced pressure are within the scope of this disclosure.

When reference is made to sealing the barrier material to itself, or to the material used for the non-collapsible fitment 14, the method may be chosen from one of many known in the art. Illustratively, the seal is tight enough to endure force of vacuum down to 100 Pa or pressure up to 40 psi, more preferably, down to 50 Pa or even 20 psi, and most preferably down to 5 Pa. Heat sealing is one of the more commonly used methods, whereby heat is used to fuse the barrier material to itself or to different materials and thereby form a seal. For example, as shown in FIG. 1B, seams 54 are created by heat sealing top layer 20 to bottom layer 24. Interior region 30 is defined between spaced-apart seams 54 and bottom 28 of collapsible compartment 12. Adhesive joining may also be used, whereby an adhesive is applied to one or both layers 20, 24 to be sealed prior to sealing. Welding techniques, such as radio frequency welding and ultrasonic welding also may be used depending on the barrier material and other materials to which the barrier material needs to adhere. Infrared can in some cases be used to seal barrier material. Other methods of sealing a pouch are known in the art and are within the scope of this disclosure.

When reference is made to fitment 14, the term is used to describe a non-collapsible part of the pouch assembly 10. The term non-collapsible is herein used in reference to the fitment 14 and the ability of fitment 14 to withstand certain negative pressures applied thereon without substantially collapsing or deforming cavity 18 and/or other passageways formed within fitment 14. Fitment 14 is constructed from material chosen from a variety of plastics, including the use of two or more different plastics to provide different characteristics for different parts of the fitment 14. For example, the body of fitment 14 may be made of a rigid plastic having an elastomeric overmold. Illustratively, the fitment 14 should be firm enough so that cavity 18 will not significantly change volume under vacuum, but also soft enough so that seal 46 can be easily punctured by a cannula, or the like, leaving a relatively clean break in the puncture region so as not to release debris that can block the channel 44 through which fluids are introduced into the cavity 18. For example, fitment 14 may be made of a material which collapses approximately 5-10% when under vacuum. However, in some embodiments a more flexible material may be used for the fitment, particularly if the fitment material flexes in a uniform manner and provides a uniform volume in the cavity. Although illustrative seal 46 is made from the same material as fitment 14, it is within the scope of this disclosure to include a seal made of other materials such as, for example, the barrier material. Optionally, the material used in seal 46 is capable of self-sealing to minimize leakage or backflow. Furthermore, the material of the fitment 14 should adhere tightly to the barrier material by means of sealing, as described above.

Other characteristics of the fitment material are dictated by the storage and use conditions of the pouch assembly 10, which can be selected by those skilled in the art. Illustratively, the fitment 14 may be manufactured from polypropylene. As mentioned above, however, fitment 14 may also be made of an elastomeric material or may be made of a more rigid plastic and an elastomeric overmold. Other suitable materials may be used. Further illustratively, the fitment 14 may be injection molded from a plastic material and the cavities and passageways of fitment 14 may be formed therein during the injection molding process. Alternatively, the cavities and passageways may be formed by machining after the injection molding process.

When reference is made to the plunger 16, the term is used to describe a movable part that is inserted into cavity 18 of fitment 14. The plunger 16 illustratively can be constructed from materials selected from a group of hard plastics, soft rubber, or soft plastics that will seal the fitment cavity 18 to hold vacuum. The choice of material of plunger 16 may depend on the fitment material, particularly the material used at a seal surface 34 of fitment 14 defining cavity 18 that will be in contact with the plunger 16. If the seal surface 34 is a hard plastic, for example, then a soft rubber or soft plastic may be used as plunger material. Alternatively, if the seal surface 34 is a soft plastic, for example, then a hard plastic plunger material often will be appropriate, with use of vacuum grease (not shown), if desired, on the seal surface 34. Furthermore, the plunger material should accommodate designs to prevent backflow when the plunger 16 is used to push fluid into the interior region 30 of one or more collapsible compartments 12. For example, a plunger formed by injection molding, for example, may include a parting line formed where two injection mold components, for example, come together. This parting line of the plunger may lie along the seal surface 34 of cavity 18 and may permit the fluid sample to flow back up along the parting line of the plunger rather than into the compartments. In other words, a plunger having a smooth, uniform outer surface for engaging seal surface 34 of cavity 18 to form a seal may prevent backflow of the fluid sample as the fluid sample is moved to the compartment. Similarly, notch 52 of plunger allows incoming fluid through channel 44 to enter cavity 18 when notch 52 is aligned with channel 44. The plunger 16 can then be rotated to block channel 44 when plunger 16 is fully depressed to move the fluid within cavity 18 to the compartment 12 without allowing the fluid to move back into channel 44.

As mentioned above, in the embodiment shown in FIGS. 1A-2E, a barrier material is folded, and/or sealed to itself, on three sides generating the collapsible compartment 12, leaving the fourth side open to be sealed to the fitment 14. When the barrier material is sealed to a fitment 3, collapsible compartment 12 is fluidly connected to the fitment cavity 18. As shown, plunger 16 is partially inserted to a first position within the cavity 18 so as to leave open port 36, and channel 44, as shown in FIGS. 1A and 2A. Air is evacuated from the pouch assembly 10, illustratively by placing the whole pouch assembly 10 into a vacuum chamber (not shown). Vacuum is applied and air within the pouch assembly 10 is evacuated through port 36. The compartment 12 is collapsed at this point, with top and bottom layers 20 and 24 in full contact with each other, as shown in FIG. 2B.

Preferably a vacuum of 240 Pa or less is used, and most preferably a vacuum of 7 Pa or less is used. The length of time required for evacuating air depends on several factors including, but not limited to, the size of the pouch assembly, duration required to degas the barrier material and materials used for the fitment and plungers, air penetration and out-gassing rates of said materials, and the required shelf life of the pouch assembly. Typically, a pouch assembly, such as the pouch assembly shown in FIG. 1A, may be degassed under a moderate vacuum anywhere between 12 and 72 hours. The conditions of vacuum can be optimized by those skilled in the art.

After an appropriate amount of vacuum is applied, plunger 16 is lowered to a second position within cavity 18 where port 36 is blocked and a volume of space within cavity 18 unoccupied by plunger 16 is reduced to a predetermined volume. The final level of vacuum and volume of cavity 18 define a predetermined volume of fluid sample that will be drawn into cavity 18, as shown in FIG. 2B. Said volume may be equal to or smaller than the fully inflated volume of compartment 12, and may also depend on the actual biochemical or chemical reaction process to be performed. At this stage, channel 44 has access to cavity 18; i.e. is not blocked by the plunger 16. Illustratively, notch 52 formed in the plunger 16 provides this access, as shown in FIG. 2B. However, it is within the scope of this disclosure to include other means of providing access between port 42 and cavity 18 when plunger 16 is in the second position. For example, port 42 may be positioned further away from port 36. An optional holding device can be used to secure the position of the plunger 16, as shown, for example, in FIGS. 5-7B as comb or separator 470 of a pouch assembly 410 discussed in greater detail below. For storage, the pouch assembly 10 optionally can be placed inside another vacuum evacuated pouch capable of holding a vacuum illustratively around 500 Pa. In an alternative embodiment, the pouch assembly optionally can be placed inside an air-evacuated air-tight non-collapsible container or alternatively, inside a pouch with an internal rigid frame or container that provides a non-collapsible space of vacuum large enough to hold the pouch assembly, and to maintain the vacuum inside the pouch assembly and keep compartments fully collapsed during long-term storage.

In using the air-evacuated pouch assembly 10, illustratively, a fluid sample 56 is placed in a container (not shown) with a syringe having a cannulated tip that can be inserted into sample entry port 42 to puncture seal 46 therein. Alternatively, the fluid sample 56 may be withdrawn directly from its source through a cannula, or the like. When seal 46 is punctured, the fluid 56 is withdrawn from the container (or its source) due to the negative pressure within cavity 18. Fluid 56 then passes through port 42 and channel 44 to fill cavity 18, as shown in FIG. 2C. At this point, the fluid 56 usually does not enter collapsed compartment 12. The fluid sample 56 can be liquid, gel, or gas as long as the fluid sample 56 is capable of being drawn into cavity 18 by force of vacuum. Finally, the plunger 16 is lowered to a third position within cavity 18 to lie at a bottom of cavity 18 generally flush with bottom surface 26 of fitment 14, as shown in FIG. 2E, to push the fluid 56 into the flexible compartment 12, where biochemical, or chemical reactions can take place, and analysis may be performed by optical or other means of interrogation.

If a plunger design is used including notch 52, as illustrated in the embodiment shown in FIGS. 1A-2E, the plunger 16 may be rotated, as shown in FIG. 2D, prior to being lowered so as to offset notch 52 and to close off channel 44 from communication with cavity 18. This acts to minimize any potential backflow of fluid through channel 44 to the surrounding atmosphere. As mentioned above, although notch 52 is shown and described above with respect to plunger 16, it is within the scope of this disclosure to close off either channel 44 or sample entry port 42 soon after dispensing the fluid sample 56 into the cavity 18 by other means, such as depressing plunger 16 toward the bottom of cavity 18, heat sealing, unidirectional valves, or self-sealing ports, for example.

Prior to use, reagents (not shown) may also be placed either in the cavity 18 or in the collapsible compartment 12, or in both. The reagents may then be dried through the vacuuming process. A freeze-dryer or a lyophilizer can be used to apply vacuum. It is contemplated that after a fluid sample 56 is dispensed into the fitment 14 of such a pouch assembly 10 having reagents therein prior to injection of the fluid sample 56, the fluid sample 56 is mixed with dried reagents in the fitment cavity 18, and the resulting mixture is transferred to the collapsible compartment 12. It is further contemplated that a first reaction may take place within the fitment cavity 18, and a second reaction may take place within the flexible compartment 12, particularly if cavity 18 and compartment 12 each contain different reagents.

Figure 3A:
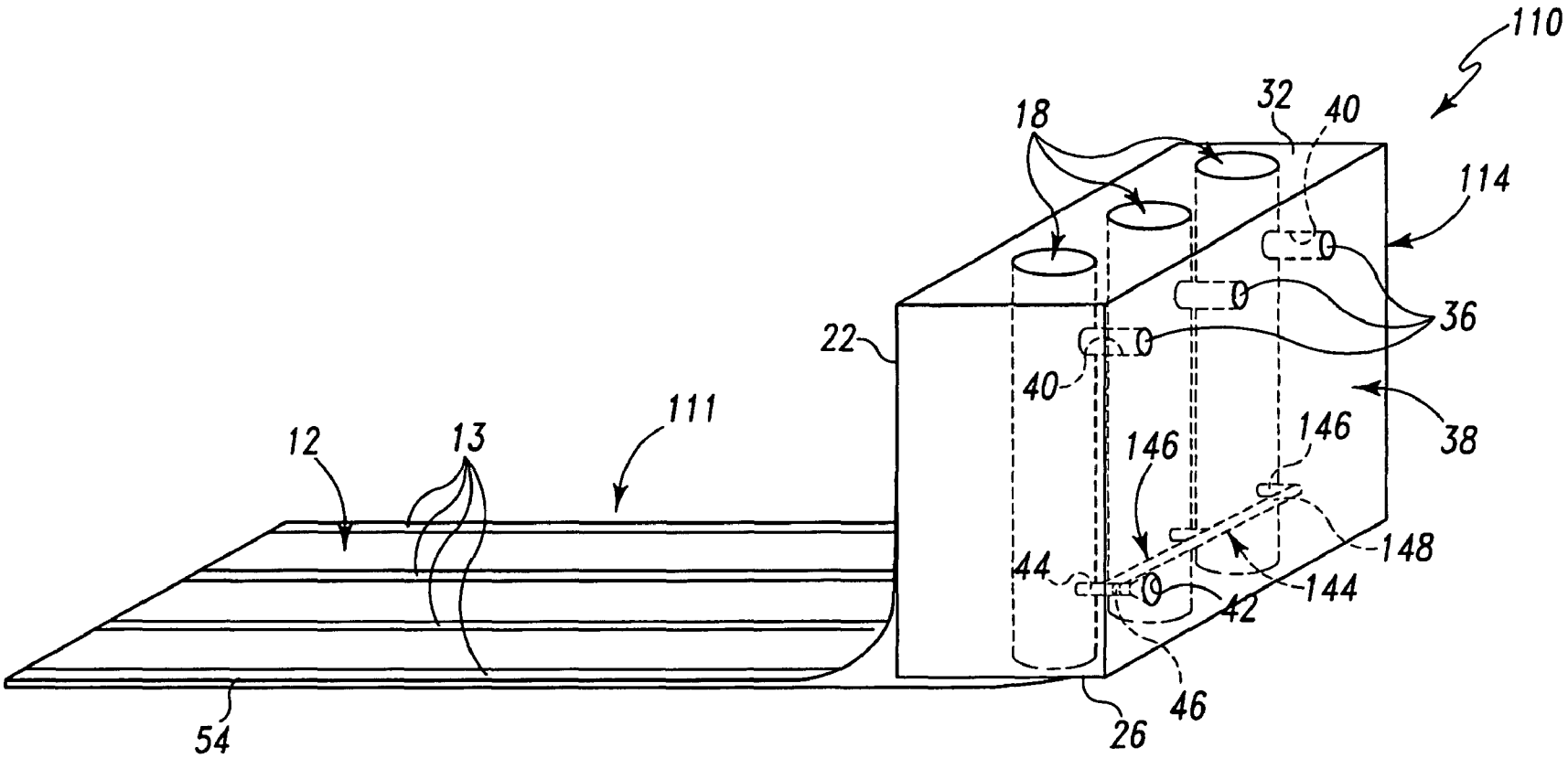
FIG. 3A is a perspective view of a multi-compartment pouch assembly of the present disclosure showing a multi-cavity fitment of the assembly having a single sample entry port in communication with branched channels capable of distributing a fluid sample to the multiple cavities, and also showing a collapsible compartment in communication with each cavity of the fitment.

In a further embodiment, shown in FIG. 3A, another illustrative pouch assembly 110 is provided. Pouch assembly 110 is similar to pouch assembly 10, and therefore, like reference numerals have been used to identify like components. Pouch assembly 110 includes a row 111 of collapsible compartments 12 divided by seams 54 created by sealing the barrier material, as described above. Pouch assembly 110 also includes a fitment 114 coupled to row 111 of compartments 12. Fitment 114 includes three cavities 18 spaced-apart from one another. Illustratively, row 111 includes three compartments 12 such that each compartment 12 is in communication with a corresponding cavity 18 of fitment 114. Illustratively, each compartment-cavity combination is sealed from fluid communication with any other compartment or cavity. Therefore, the cavities 18 are in one-to-one communication with their respective compartments 12.

Fitment 114 of pouch assembly 110 also includes three separate vacuum ports 36 spaced-apart from each other. Each vacuum port 36 is in communication with one of the three cavities 18 of fitment 114. Fitment 114 further includes sample entry port 42. An interior branched channel 144 of fitment 114 (shown in phantom in FIG. 3A) provides communication between sample entry port 42 and each of the three cavities 18 of fitment 114. For example, channel 144 includes branches 146 which extend from a main passageway 148 of channel 144 to each cavity 18. Seal 46 is provided within channel 144 near sample entry port 42 prior to communication with main passageway 148 of channel 144. Pouch assembly 110 further includes three plungers 16 (not shown in FIG. 3A). Each plunger 16 is received within a corresponding cavity 18 of fitment 114.

Multi-compartment pouch assembly 110 is air-evacuated in the same manner as that described above with respect to pouch assembly 10. Once air has been evacuated and the respective plungers 16 have been depressed to their second position within cavity 18 to block each respective port 36, a fluid sample (not shown) may be introduced. In using multi-compartment pouch assembly 110, a sample is dispensed through the single sample entry port 42 to the multiple cavities 18 through branched channel 144 that is in communication with, and capable of distributing the sample to, said multiple cavities 18, as shown in FIG. 3A. A substantially equal predetermined amount of the fluid sample is drawn into each respective cavity 18. In this configuration, it may be important to optimize the dimension and design of the branched channel 144 to minimize diffusion and mixing of fluid between multiple cavities prior to closing off the access to channel 144 by plungers 16 or other means. In the example of a liquid sample, such design optimization of channel 144 can be achieved by use of different color dyes placed in each fitment cavity 18, injecting a liquid similar or equal in density and viscosity to the sample, and following the diffusion and mixing rate of the colored liquid across cavities. In an exemplary operational design, diffusion and mixing of water-based liquid between multiple cavities are minimized when channel 144 has a square cross-section of about 1 mm along its entire path, when the path is approximately 1-3 cm per branched channel, and when the sealing event can be performed between 10 seconds to 10 minutes after injection of the liquid. Diffusion may further be minimized by either further decreasing the dimension of the channel, further increasing the distance between fitment cavities, or further decreasing the time between sample injection and sealing. Optionally, mixing may be prevented by using unidirectional valves at or near the junction between channel 144 and each fitment cavity 18.

Figure 3B:
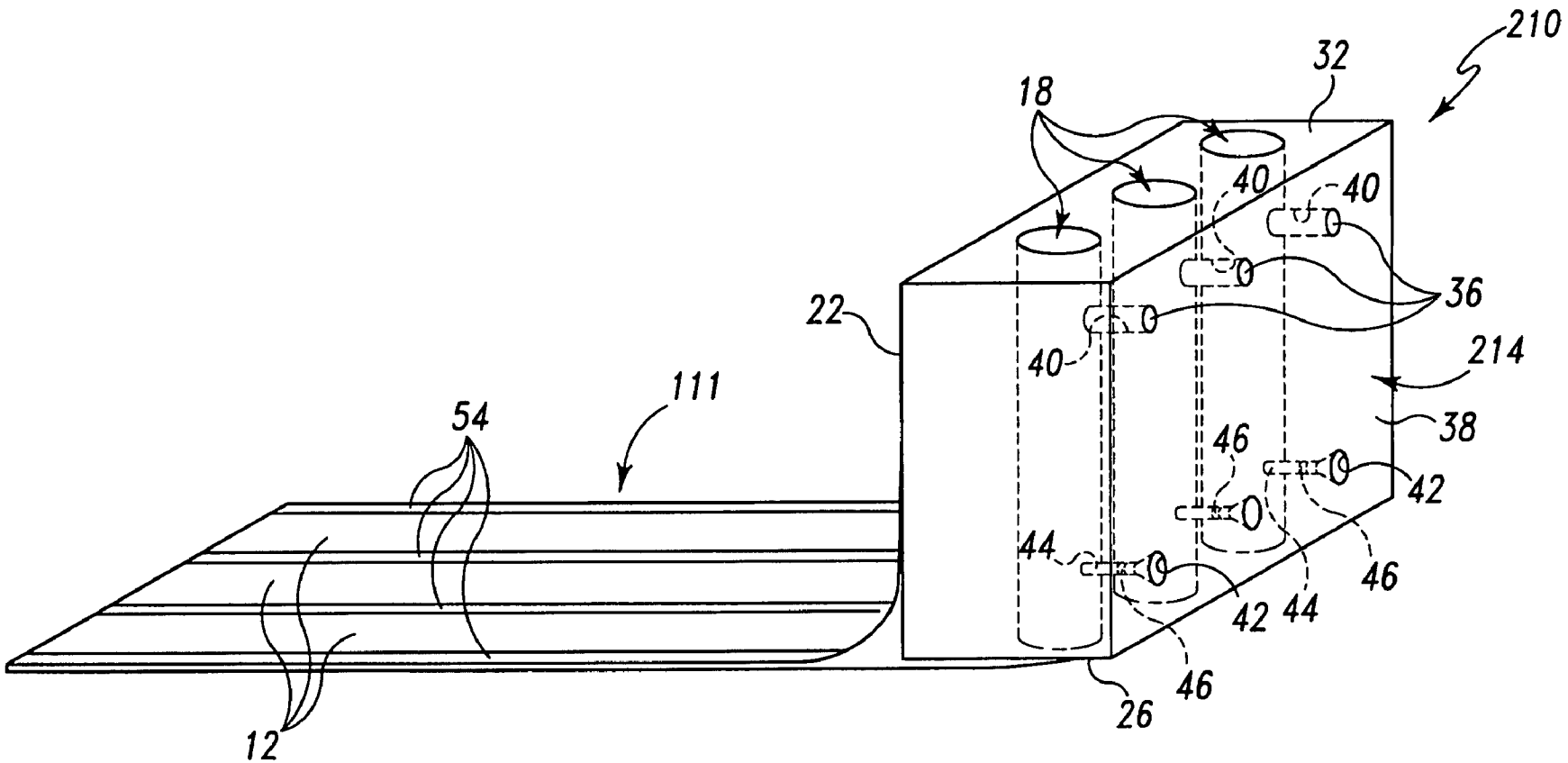
FIG. 3B is a perspective view of another multi-compartment pouch assembly similar to the assembly shown in FIG. 3A showing a sample entry port in communication with each cavity for distributing one sample to one cavity at a time.

Yet another pouch assembly 210 is shown in FIG. 3B. Pouch assembly 210 is a multi-compartment pouch assembly similar to assembly 110 shown in FIG. 3A. Similarly, like reference numerals are used to identify like components. Pouch assembly 210 includes row 111 of compartments 12 coupled to a fitment 214. Different from fitment 114, fitment 214 includes three separate sample entry ports 42 formed therein as well as three separate channels 44. Each channel 44 is in communication with one of the sample entry ports 42 and a corresponding cavity 18. Similar to fitment 14 of pouch assembly 10, a seal 46 is provided within each channel 44. In using this multi-compartment pouch assembly 210, each injected sample (not shown) is individually dispensed into single cavities 18. Although not shown, three plungers 16 are provided in pouch assembly 210. Each plunger 16 is to be received within one of the three cavities 18 as is described above with respect to the aforementioned embodiments.

Figure 4A:
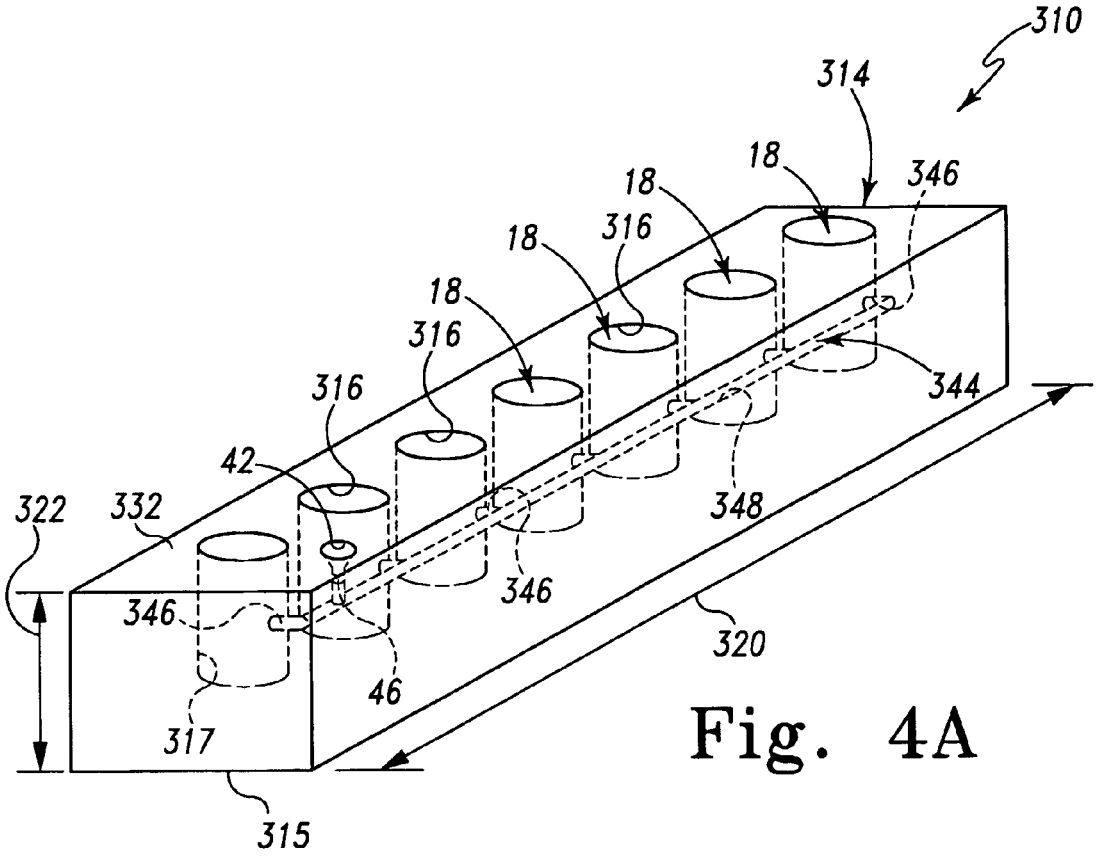
FIG. 4A is a perspective view of yet another pouch assembly of the present disclosure showing a fitment of the pouch assembly including branched channels in communication with a single sample entry port for distributing one sample to multiple cavities of the fitment.
Figure 4B:
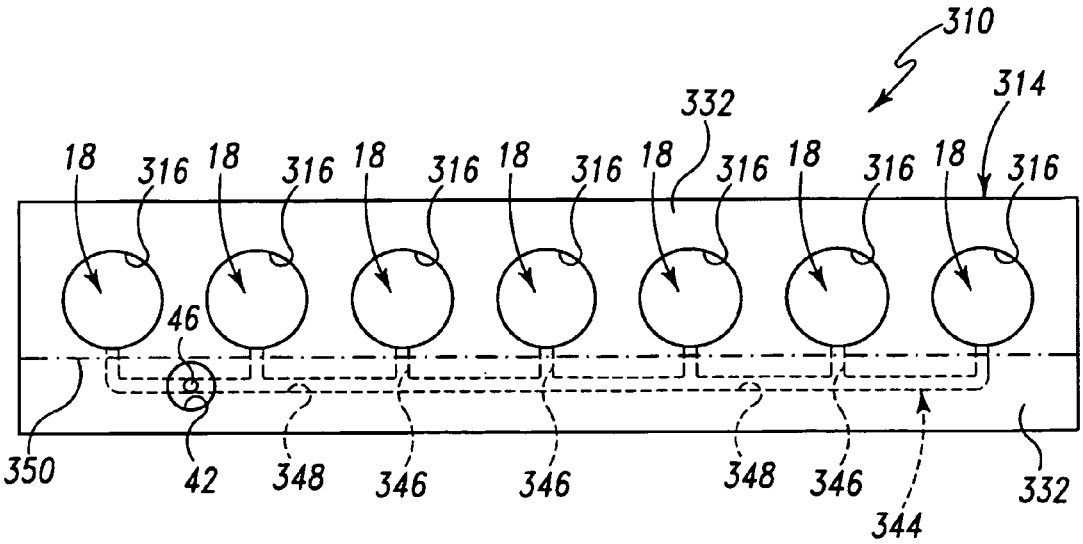
FIG. 4B is a top view of the pouch assembly of FIG. 4A showing the branched channels (in phantom) in communication with the sample entry port as well as each cavity for distribution of one sample to the multiple cavities, and also showing a line along which the branched channels may be heat sealed, for example, to close each cavity from communication with the sample entry port.

In yet another embodiment, shown in FIGS. 4A and 4B, an alternative pouch assembly 310 is provided. Pouch assembly 310 includes a fitment 314 comprised of multiple cavities or wells 318, illustratively, seven cavities 318, connected by a channel 344, similar to channel 144 shown in FIG. 3A with respect to fitment 114. Illustrative channel 344 includes single main passageway 348 formed to extend along a length 320 of fitment 314 and multiple branches 346 each connecting a cavity 318 with the main passageway 348. Illustratively, therefore, there are seven branches 346. Illustrative fitment 314 has a height 322 smaller than an illustrative height of the fitments 14, 114, 214 described above. A single sample entry port 42 of fitment 314 is formed in a top surface 332 of fitment 314. Sample entry port 42 is in communication with main branch 348 of channel 344. The seal 46 is provided between sample entry port 42 and main branch 348.

In this embodiment, the pouch assembly 310 lacks the collapsible compartments and plungers described above with respect to pouch assemblies 10, 110, and 210. Further, each cavity 318 is defined by a closed bottom surface 315 and an open top aperture 316 formed in a top surface 332 of fitment 314. Reagents are placed into each of the cavities 318 through the open aperture 316, and then dried or immobilized onto the interior surface 317 of the cavities 318 by methods known in the art. After evacuation of air, the open top aperture 316 is sealed with a material 347 (shown in FIG. 4C) so that an unoccupied space of each cavity 318 is now reduced to a predetermined volume. The material used to seal the open top 316 may be, for example, the same material as assembly 310. Alternatively, a flexible barrier material may be used and may be attached to top surface 332 of fitment 314 by heat sealing, for example. The material used to seal the open top aperture 316 may also seal sample entry port 42, to provide seal 46.

When the seal 46 is punctured, and a fluid sample (not shown) is taken in, the fluid sample is distributed into each cavity 318 through channel 344. After the fluid sample is dispensed into each cavity 318, access from each cavity 318 to channel 344 may be closed by heat sealing or other means. Branches 146 of channel 144 may be heat sealed along line 350, for example. If reagents are dried in the cavities 318, then the dimensional design of channel 344 may be optimized to minimize diffusion of sample across cavities before said sealing event. Such design may include the use of narrower channels closer to the position of the seal 46, as discussed above. Channel 344 can be embedded inside fitment 314, or alternatively etched on the top surface 332 of fitment 314. This etched channel (not shown) may be later covered when the cavities 318 are sealed at the open aperture 316 by barrier material or the like.

Figure 4C:
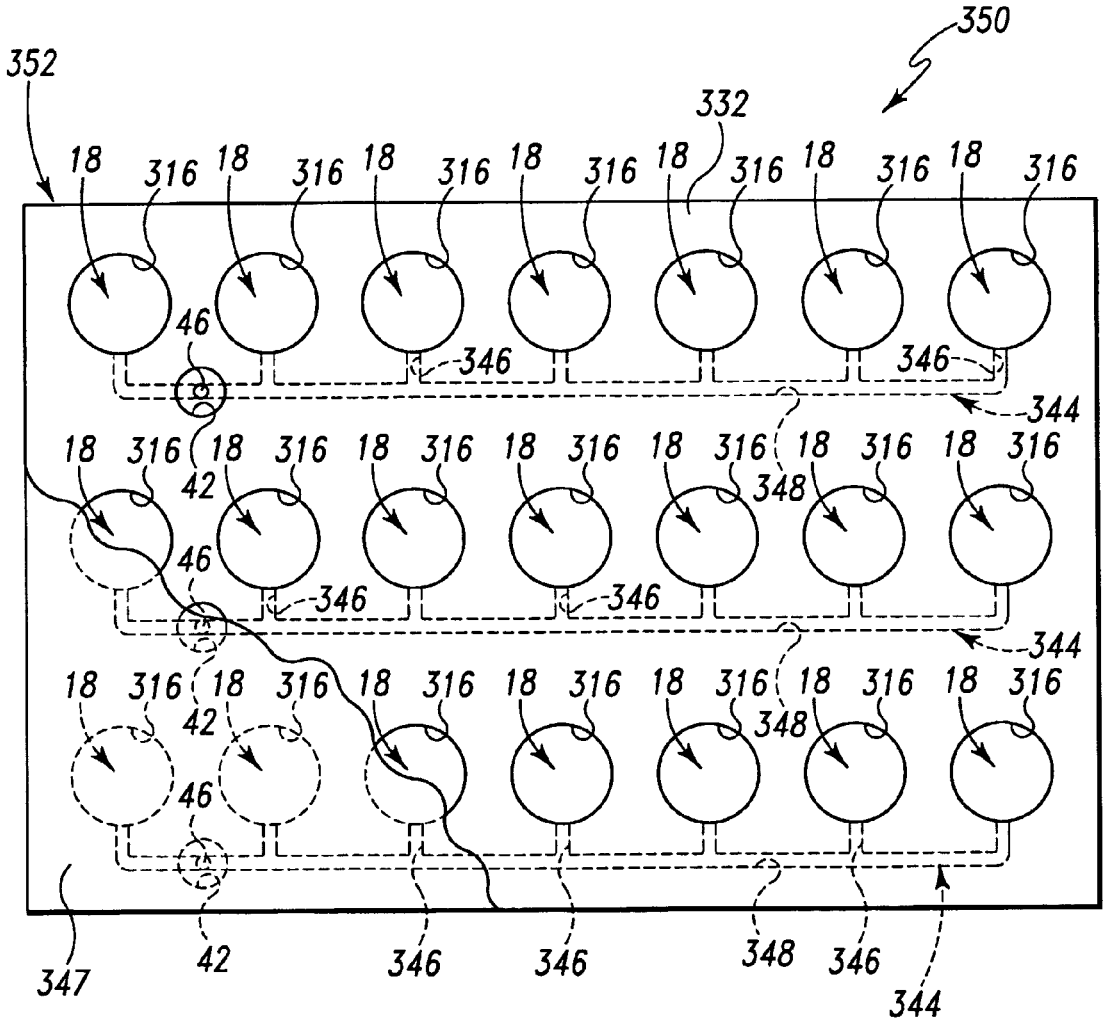
FIG. 4C is a top view of another alternative pouch assembly of the present disclosure similar to the pouch assembly shown in FIGS. 4A and 4B showing a row of cavities, wherein each row of cavities is each in communication with a sample entry port and also showing a branched channel communicating between the sample entry port and each cavity of the row.

In a further embodiment, shown in FIG. 4C, a pouch assembly 350 is provided including a fitment 352 having a two-dimensional row of cavities 318. Each row is provided with channel 344, although other arrangements are contemplated. Each channel 344 is in communication with one sample entry port 42 formed in top surface 332 of fitment 352. Although the illustrated embodiment shows an array of three rows of seven cavities, other arrangements are within the scope of this disclosure. For example, a pouch assembly 350 may be arranged like a microtiter plate, for example, a 96, 384, or 1536 well plate. Samples may then be processed using standard devices configured to receive microtiter plates. Optionally, cover 347 may be removable for further processing of the contents of cavities 318.

Yet another embodiment is shown in FIGS. 5-7B. Illustratively, a twelve-compartment pouch assembly 410 is shown. Pouch assembly 410 is similar to pouch assemblies 10, 110, and 210. Pouch assembly 410 includes a row 111 of compartments 12. Specifically, row 111 includes twelve compartments 12. The row 111 is coupled to a fitment 414 of pouch assembly 410.

Figure 5:
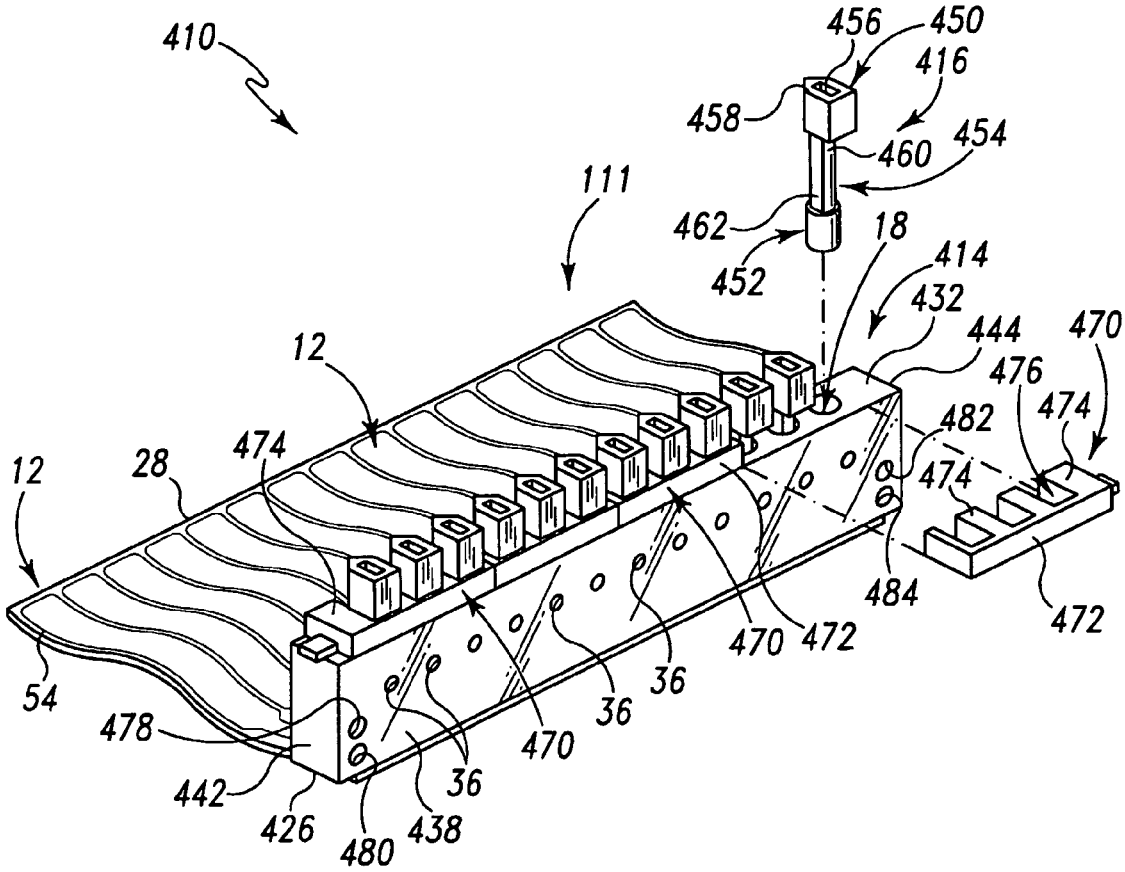
FIG. 5 is a partially exploded rear view of a twelve-compartment pouch assembly of the present disclosure showing the assembly including a fitment having twelve cavities, a plunger positioned within each cavity, and a multi-compartment pouch coupled to the fitment to provide a collapsible compartment in communication with each cavity, and also showing a comb or separator of the pouch assembly provided to hold each plunger in a particular position corresponding to a predetermined volume of space unoccupied by the plunger of each cavity.
Figure 6:
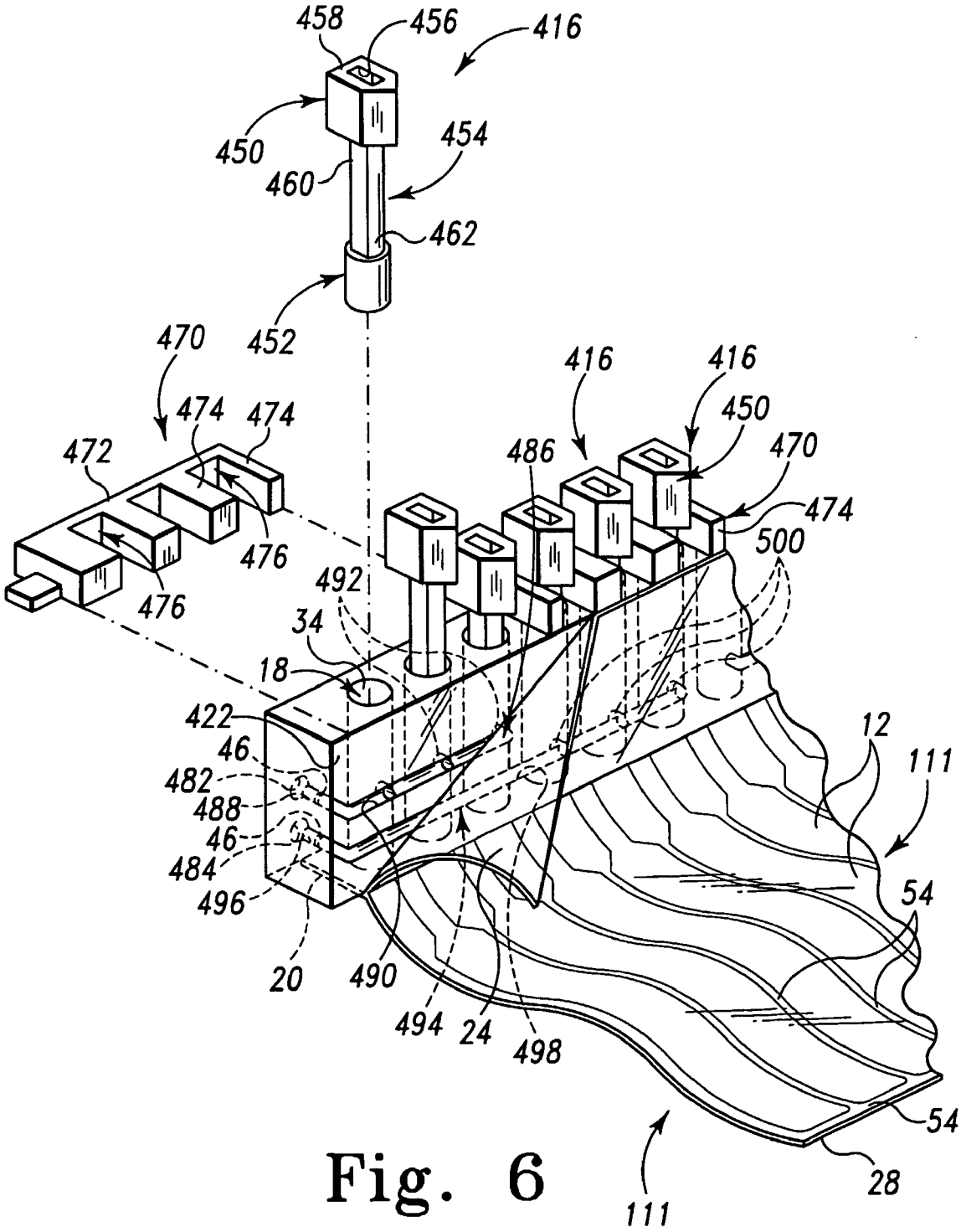
FIG. 6 is a partially exploded front perspective view of a portion of the pouch assembly of FIG. 5 showing a network of branched channels in communication with various sample entry ports as well as the cavities of the fitment for distributing a single fluid sample to three separate cavities at one time.

As shown in FIGS. 5 and 6, fitment 414 includes a top surface 432, a bottom surface 426, a front surface 422, a rear surface 438, and end surfaces 442 and 444. Fitment 414 further includes twelve cavities 18 spaced-apart from each other and each formed through fitment 414 to extend from top surface 432 to bottom surface 426. Although illustrative fitment 414 includes twelve cavities 18, it is within the scope of this disclosure to include a fitment having any suitable number of cavities formed therein.

In addition to fitment 414, pouch assembly 410 further includes twelve plungers 416 each received within one of the corresponding cavities 18, as shown in FIGS. 5 and 6. Each plunger 416 includes a top head portion 450, an end portion 452, and a central neck portion 454 positioned between and coupled to both the top head portion 450 and the end portion 452. Illustrative head portion 450 is pentagonal in shape and includes a notch 456 formed in a top surface 458 of head portion 450. Notch 456 is provided for use during optional automated filling of pouch assembly 410.

Neck portion 454 includes a first end 460 coupled to the head portion 450 and a second end 462 coupled to the end portion 452. Illustrative neck portion 454 has a smaller cross-sectional region or diameter than head portion 450. Illustrative neck portion 454 is approximately 20 mm long. End portion 452 is coupled to second end 462 of neck portion 454 and is generally cylindrical in shape. A cross-sectional region or diameter of end portion 452 is slightly larger than the cross-sectional region of neck portion 454. Thus, as illustrated, neck portion 454 is narrower than both head portion 450 and end portion 452. Similarly, a diameter of end portion 452 is approximately 5 mm and the diameter of each cavity 18 is approximately 5 mm to ensure a press-fit between end portion 452 of plunger 416 and the sealing wall or interior surface 34 defining each cavity 18. As discussed above with reference to plunger 16, end portion 452 of plunger 416 similarly includes notch 52 formed therein, as shown in FIG. 7A.

In addition to the twelve compartment row 111, fitment 414, and plungers 416, pouch assembly 410 further includes a comb or separator 470 normally positioned between top surface 432 of fitment 414 and head portion 450 of plunger 416, as shown, for example, in FIGS. 5 and 6. Separator 470 acts as a lock to maintain the plungers 416 in a particular position relative to fitment 414. Illustrative separator 470 is shaped like a comb and includes a connecting backbone 472 and multiple teeth 474 extending therefrom. Teeth 474 are spaced-apart from each other to define notches 476 of separator 470 each formed to receive a portion of the neck portion 454 of a respective plunger 416 therein. Illustrative comb 470 is divided into four comb portions, as shown in FIG. 5 such that each comb portion communicates with three respective plungers. As is discussed in more detail below, this allows a user to operate only one set of three plungers at any desired time.

Looking now to FIG. 5, fitment 414 includes a vacuum port 36 associated with each cavity 18. Thus, fitment 414 includes twelve vacuum ports 36. Although fitment 414 includes a separate vacuum port 36 for each cavity 18, it is within the scope of this disclosure to include a fitment having only one vacuum port 36, for example, which is interconnected through a network of channels to each cavity 18 of fitment 414. Fitment 414 further includes four sample entry ports 478, 480, 482, 484 each formed through rear surface 438 of fitment 414. First and second sample entry ports 478, 480 are formed at a left end of fitment 414 (as shown in FIG. 5) while third and fourth sample entry ports 482, 484 are formed at a right end of fitment 414.

Figure 7A:
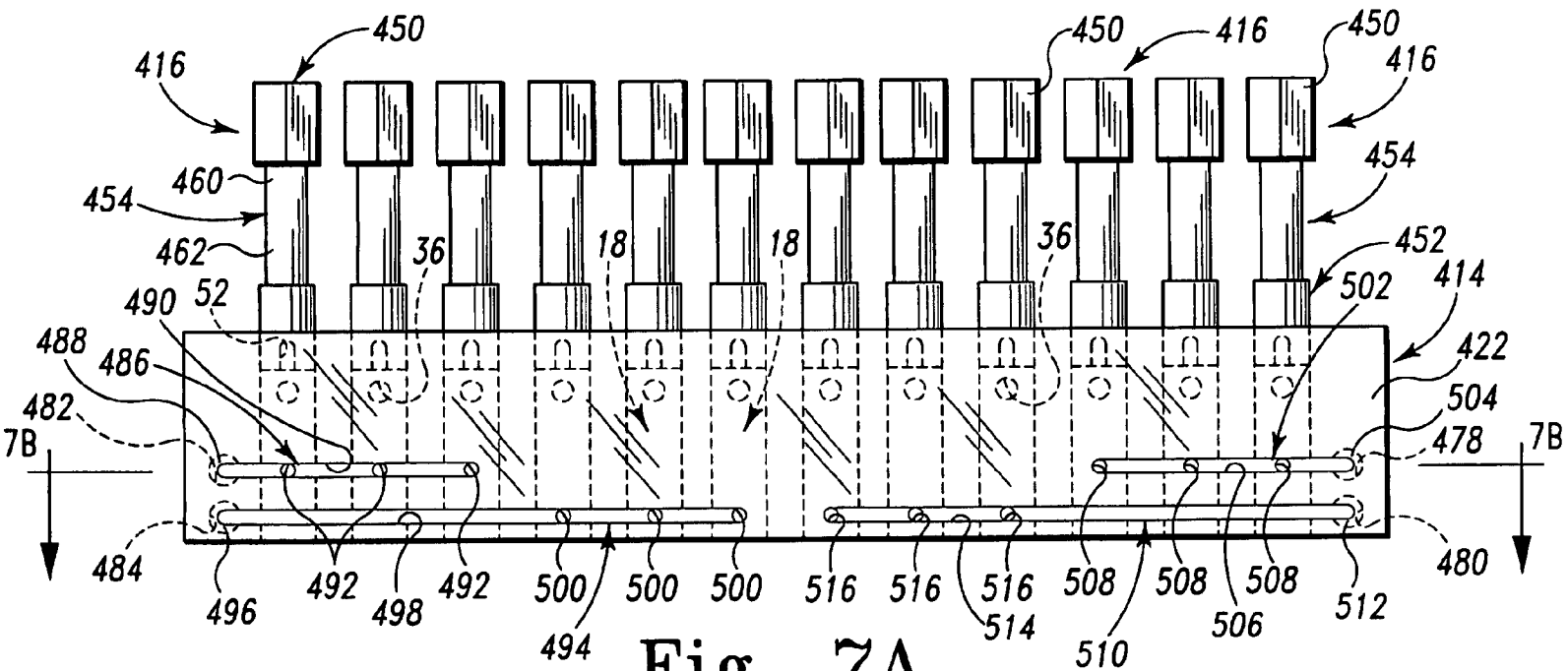
FIG. 7A is a front view of only the fitment and plungers of the twelve-compartment pouch assembly shown in FIGS. 5 and 6 showing the plungers of the assembly at a first, raised position within each cavity in preparation for evacuation of each cavity, and further showing the multi-compartment pouch of the assembly having been removed to expose the network of channels etched into a front surface of the fitment.
Figure 7B:
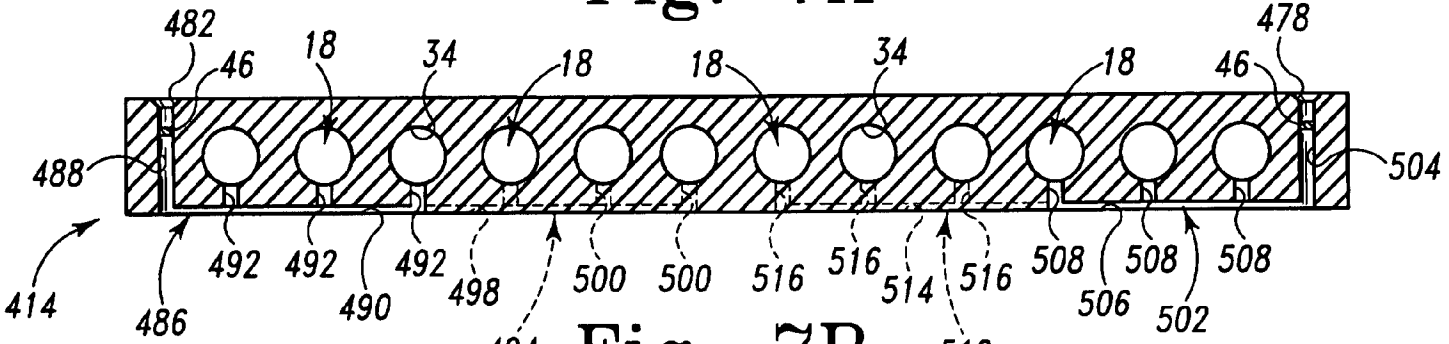
FIG. 7B is a sectional view taken along line 7B-7B of FIG. 7A.

Fitment 414 further includes multiple channels in communication with sets of cavities 18 of fitment 414, as shown in FIGS. 6, 7A, and 7B. A channel 486 communicates with third sample entry port 482 via a passageway 488 of channel 486. Channel 486 further includes a main passageway 490 and three branches 492. Each branch 492 provides communication between the main passageway 490 and a corresponding cavity 18. The channel 486 thus operates similarly to channel 144 disclosed above with respect to pouch assembly 110. Another channel 494 communicates with fourth sample entry port 484 via a passageway 496 of channel 494. Channel 494 further includes a main passageway 498 and three branches 500 extending therefrom. Each branch 500 provides communication between the main passageway 498 and a corresponding cavity 18.

Similarly, another channel 502 is provided to communicate with the first sample entry port 478 and includes a passageway 504 in direct communication with the port 478 as well as a main passageway 506 etched in front surface 422 of fitment 414 and three branches 508 connecting the main passageway 506 to three cavities 18. Another channel 510, similar to channel 494, is provided to communicate with second sample entry port 480 and includes a passageway 512 in direct communication with the port 480 as well as a main passageway 514 etched in front surface 422 and three branches 516 connecting the main passageway 514 to three cavities 18. Thus, via the system of channels 486, 494 502, 510 each of the first, second, third, and fourth sample entry ports 482, 484, 478, 480 is in fluid communication with three corresponding cavities 18. Although main passageway 490, 498 506, 514 of the channels 486, 494, 502, 510 are etched in front surface 422 of fitment 414, it is within the scope of this disclosure to provide channels or passageways formed through fitment 414 similar to the channels 144 of fitment 114, for example. The illustrative main passageways 490, 498, 506, 514 which are etched into front surface 422 of fitment 416 are sealed by a portion of bottom layer 24 of row 111 of compartments 12, as shown in FIG. 6.

As mentioned above, fitment 414 includes four sample entry ports 478, 480, 482, and 484 each with seals 42 positioned therein, which if broken will connect each port 478, 480, 482, 484 with three corresponding cavities 18 via the branched channels 486, 494, 502, 510 described above. As shown in FIG. 7A, plungers 416 are in a first position inserted partially in said cavities 18 to expose the vacuum port 36 to allow air to be evacuated from within pouch assembly 410. Illustratively, after air is evacuated from the pouch assembly 410, the volume of open space unoccupied by a respective plunger 416 within each cavity 18 is adjusted by lowering each plunger 416 to the second position shown in FIG. 5 to block vacuum port 36 while leaving open access of each cavity to the respective sample entry ports 478, 480, 482, 484. The plungers 416 are locked or secured in this second position illustratively by comb 470. When the seal 42 of one of the sample entry ports 478, 480, 482, 484 is broken, the fluid sample is withdrawn by force of the vacuum from the three corresponding cavities 18 in communication with that particular sample entry port. In one embodiment, the diameter of channels 486, 494, 502, 510 is kept small, such as, for example, approximately equal to or less than 1 mm, to minimize diffusion of fluid across cavities 18.

Subsequently, the comb 470 or a portion of the comb 470 is disengaged from fitment 414, and the respective unlocked plungers 416 are twisted to seal access (in the form of notch 52) between each cavity 18 and respective channels 486, 494. The unlocked plungers 416 are then lowered to the bottom of cavity 18 to the third position to dispense the fluid sample into the three respective compartments 12 in communication with the three cavities 18. Optionally, as mentioned above, comb 470 may be broken into multiple sections to secure a certain number of plungers 416 in the second position within each cavity 18. Illustratively, comb 470 is broken into four sections. Each comb section includes three detents 476 for receiving a portion of three plungers 416 therein to lock or secure three plungers 416 in the second position. Thus, a three-plunger section of the comb 470 may be removed to activate three plungers 416 at one time while reserving the remaining plungers 416 for later use. Alternatively, comb 470 may be provided in a unitary piece for activation of all 12 plungers.

It is contemplated that the devices of the present disclosure may be used for testing multiple pathogens or multiple genes from a single source. As illustrated, the device of FIGS. 4A and 4B is configured for testing a single sample for seven items, while the device of FIGS. 5-7B is configured for performing three tests each on four samples. Other configurations are within the scope of this disclosure.

The following examples are given to illustrate various embodiments which have been made with the present invention. It is to be understood that the following examples are not comprehensive or exhaustive of the many types of embodiments which can be prepared in accordance with the present invention.

EXAMPLE 1

A twelve-compartment pouch assembly 410 (FIGS. 5-7B) is constructed from polyethylene terephthalate-polypropylene laminates (0.48 mill PET/2 mill polypropylene-ethylene copolymer, Cello Pack, Buffalo, N.Y.) as barrier material, first by folding the barrier material on itself to form the bottom 28 of the pouch assembly row 111, and then dividing the pouch into twelve compartments 12 by heat-sealed seams 54 coextensive with the length of the compartments 12. The top of the barrier material is sealed to one end of fitment 414, which is made of Monprene, a thermoplastic elastomer (MP 1627 1.3, QST Inc., St. Albans, Vt.). This provides one-to-one communication between compartments 12 and the respective fitment cavities 18. The plungers 416 are made of solid polypropylene with vacuum grease applied to the seal surface 34. The diameter of the channels formed in fitment 414, such as channels 486, 494, 502, 510 for example, is kept at or smaller than 1 mm to minimize diffusion of fluid across cavities 18. Vacuum port 36 has a diameter of 2 mm. The main passageway of the branched channels is etched on the front surface 422 of fitment 414 and covered by a portion of bottom layer 24 of the barrier material of row 111 of compartments 12. Next, air is evacuated from the pouch assembly by use of a freeze-dryer (Virtis "Advantage", Cardiner, N.Y.) at a vacuum of 7 Pa. The length of time of lyophilizing depends upon the volume of a reagent optionally provided therein. The volume of fitment cavities 18 is the adjusted to 100 μl by lowering the plungers 416 to the second position. The plungers 416 are then secured in position by comb 470, as shown in FIGS. 5 and 6, for example. The pouch assembly 416 is then taken out of the vacuum chamber. Four hundred microliters each of water, mineral oil, and PCR mixture are separately prepared in 1 ml syringes. The PCR mixture comprises 0.2 mM DNTP, 1X IT buffer (Idaho Technology, Cat #1770, Salt Lake City, Utah), 0.04 U/μl Taq polymerase, 500 pg/μl human genomic DNA, 0.5 μM each of primers PC03 and PC04 (LightCycler manual, p27, 1997, Idaho Technology), and 3X SYBR® Green I dye (Molecular Probes, Eugene, Oreg.). Cannulas attached to each syringe are used to puncture seals through sample entry ports 42, and the liquids from each syringe are individually withdrawn by force of vacuum into three fitment cavities 18 that are in communication with channels 486, 494. After the nine cavities are completely filled with liquid, the comb 470 is disengaged, and plungers 416 are twisted to seal access to the respective channel and sample entry port, and then lowered to the third bottom position within cavity 18 to dispense the liquid into compartments 12. The microliter volume of liquid dispensed into each compartment 12 averaged 95.5±4.22. No appreciable difference was noted between the three samples, even though mineral oil has roughly 100 times higher viscosity than water or the PCR mixture. The pouch assembly was further inserted into an air thermal cycler (RapidCycler, Idaho Technology) with a modified lid so as to prevent escape of hot air from the chamber, and was exposed to 45 cycles of heating and cooling according to the referenced protocol (LightCycler manual, p31). After thermal cycling, the pouch assembly was placed on a UV transilluminater. The three compartments that contained the PCR mixture, but not those that contained mineral oil or water, were found to have 3 to 4 times higher fluorescence intensity than before thermal cycling, indicating successful amplification of a gene fragment. Amplification of DNA was further confirmed by gel electrophoresis.

EXAMPLE 2

In another example using the twelve-compartment pouch assembly 410 of FIGS. 5-7B, PCR primers and dNTPs are dispensed into cavities 18 and freeze dried for 13 hours. A solution containing genomic DNA (500 pg/μl), buffer and Taq polymerase (0.04 U/μl) was prepared in a 1 ml syringe and dispensed into the pouch assembly 416 as described above by puncture of seal through port 42 by a cannula. The force of vacuum distributed the solution equally into three fitment cavities 18. This operation was repeated four times so that all twelve cavities 18 were filled with solution. Then by twisting and lowering all of the plungers 416, the samples were transferred into the collapsible compartments 12. The pouch assembly 416 was exposed to thermal cycling as described above, and all twelve reactions successfully produced amplified DNA products.

EXAMPLE 3

Figure 8:
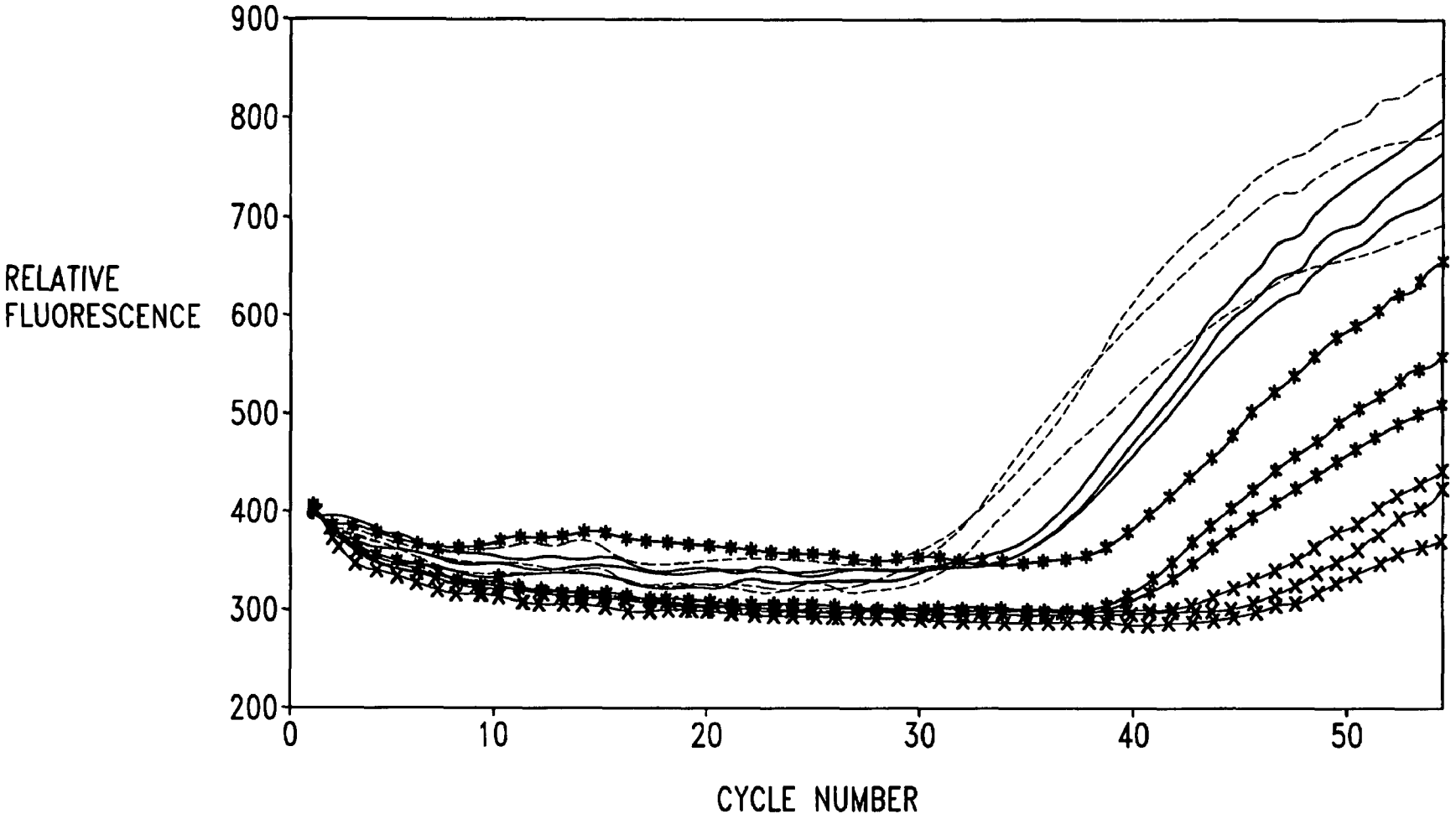
FIG. 8 is a fluorescence versus cycle number plot showing an amplification reaction as monitored once per cycle during PCR amplification. Prior to PCR, samples with different concentrations of target DNA were each dispensed into three compartments of a device of FIG. 5A-B: 10 pg/μl ( - - - ), 1 pg/μl (-), 0.1 pg/μl (-•-), and 0.01 pg/μl (-x-). Initial values were normalized to 400 relative fluorescence units.
Figure 9:
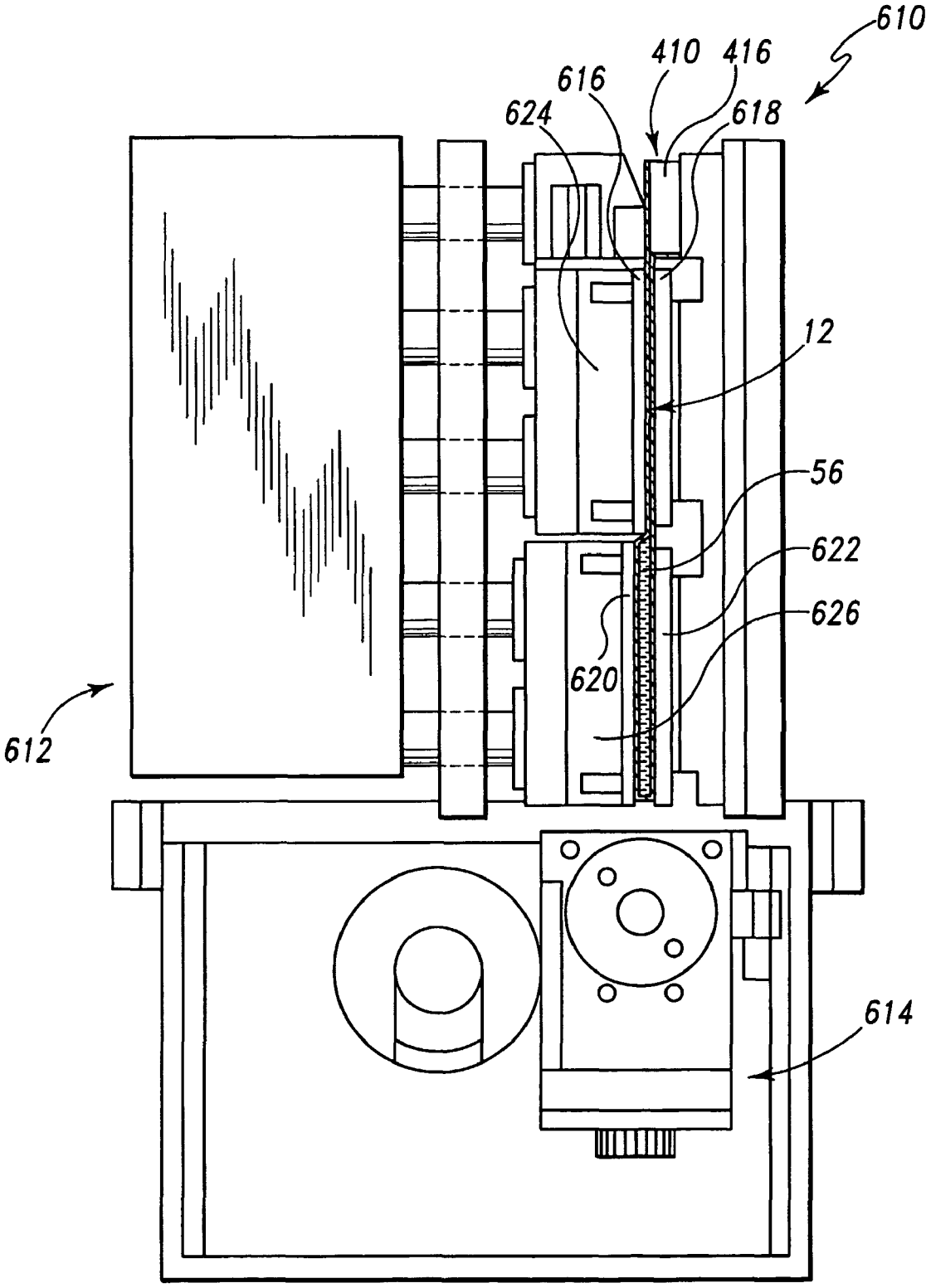
FIG. 9 is a part schematic, part diagrammatic sectional view of a real-time PCR apparatus including a thermocycling subassembly having pneumatic bladders and a fluorimeter subassembly positioned below the thermocycling subassembly, and further showing the pouch assembly of FIGS. 5-7B positioned within the PCR apparatus between heater elements of the PCR apparatus and containing a reaction mixture within the collapsible compartment in thermal contact with the lower pair of heating elements.

In yet another example using the twelve-compartment pouch assembly of FIGS. 5-7B, PCR primers (SQF and SQR) and a fluorescent probe (SQP1) specific for *Salmonella* (described in detail in U.S. Patent Application 2003/0022177 A1, herein incorporated by reference) and dNTPs are dispensed into each cavity 18 and freeze dried as described above. Buffered Taq polymerase solutions (0.04 U/μl) containing four levels of dilutions of *Salmonella* genomic DNA (10 pg/μl, 1 pg/μl, 0.1 pg/μl, and 0.01 pg/μl) were prepared in 1-ml syringes. These solutions were then each dispensed into the pouch assembly as described above by puncture of each of the seals 46, and each solution distributed equally into three fitment cavities 18 by force of vacuum so that all twelve cavities were filled. Once the samples were transferred into the collapsible compartments 12, the pouch was inserted into a thermal cycler which cycles the temperature of the samples by successive squeezing actions of movable heating elements, as shown in FIG. 9 and described by WO 03/007677 A2, herein incorporated by reference. All twelve reactions successfully produced amplified DNA products as indicated by the fluorescence signal being above background by cycle number 50, as shown in FIG. 8. The timing of fluorescence signal emerging above background inversely correlates to the initial concentration of target DNA.

Looking now to FIG. 9, a PCR apparatus 610 is provided for use in temperature controlled processes such as amplification of DNA through thermocycling and detecting and analyzing a reaction through fluorescence. Illustrative PCR apparatus 610 includes a thermocycling subassembly 612 and a fluorimeter subassembly 614 positioned generally below thermocycling subassembly 612. In general, thermocycling subassembly 612 subjects a reaction mixture or fluid sample 56 to temperature cycling, or repeated rounds of heating and cooling. Thermocycling subassembly 612 includes a first pair of heaters 616, 618 and a second pair of heaters 620, 622. Illustrative heaters 616 and 620 are movable heaters, whereas illustrative heaters 618 and 622 are stationary heaters. Movable heaters 616, 620 operate to squeeze the row 111 of compartments 12 back and forth so that the fluid samples 56 within compartments 12 are moved between the two temperature zones provided by first and second pair of heaters 616, 618 and 620, 622. It is within the scope of this disclosure to include a thermocycling subassembly having more than two temperature cycling zones.

Pneumatic bladders 624, 626 of thermocycling subassembly 612 operate to move respective heaters 616, 620 back and forth. Although illustrative pneumatic bladders are disclosed, it is within the scope of this disclosure to move heaters 616, 620 through the use of any suitable pressure-based actuator such as hydraulics, spring rows, etc., for example. As shown in FIG. 9, heater 616 is moved to a closed position to squeeze the fluid sample 56 to a lower portion of compartment 12 between the second pair of heaters 620, 622 to be heated to the temperature of heaters 620, 622. After an appropriate duration, heater 616 is moved to an opened position (not shown) and heater 622 is moved from the opened position to the closed position to squeeze the fluid sample 56 to an upper portion of compartment 12 and into full thermal contact with first pair of heaters 616, 618 to be heated to the temperature of heaters 616, 618. Thermal cycling is accomplished by repeating these steps.

Although the invention has been described in detail with reference to preferred embodiments, variations and modifications exist within the scope and spirit of the invention.

The invention claimed is:

1. A device for receiving a fluid comprising a fitment having a cavity formed therein, the cavity having a reduced pressure, the reduced pressure being below atmospheric pressure relative to an exterior surface of the fitment, and a port having a seal, the port configured to provide fluid communication from an exterior surface of the fitment to the cavity upon opening of the seal, and a collapsible compartment coupled to the fitment and in fluid communication with the cavity, a plunger inserted into the fitment, the plunger comprising a head and neck, wherein the neck is smaller than the head, and a separator that is separate from the fitment and seated on top of the fitment, the separator comprising a comb-like structure with teeth and notches.

2. The device of claim 1, wherein the reduced pressure within the cavity is operable to draw a volume of the fluid into the cavity upon opening of the seal.

3. The device of claim 2, further comprising the plunger sized to be received within the cavity, wherein the plunger is operable to direct the volume of the fluid into the collapsible compartment.

4. The device of claim 3, wherein the plunger is provided partially inserted into the cavity, the plunger comprising a notch configured to allow fluid communication between the cavity and the port when the notch is adjacent the port, but to prevent fluid communication between the cavity and the port when the notch is rotated away from the port.

5. The device of claim 1, further comprising a dried reagent contained within the collapsible compartment.

6. The device of claim 5, wherein the dried reagents include PCR buffer and polymerase.

7. The device of claim 1, further comprising a dried reagent contained within the cavity.

8. The device of claim 7, wherein the dried reagents include PCR primers and dNTPs.

9. The device of claim 1, further comprising a first dried reagent contained within the collapsible compartment and a second dried reagent contained within the cavity.

10. The device of claim 1, wherein at least a portion of the collapsible compartment is optically clear.

11. The device of claim 1, further comprising an air-evacuated air-tight non-collapsible storage container, wherein the device is provided within the storage container.

12. A device for receiving a fluid comprising a fitment comprising a plurality of cavities formed therein, each cavity having a reduced pressure, the reduced pressure being below atmospheric pressure relative to an exterior surface of the fitment, a channel fluidly connecting the cavities, a port extending from the channel to a surface of the fitment, a seal provided at the port, the seal configured to maintain the reduced pressure in the cavities prior to opening the seal, a plurality of collapsible compartments affixed to the fitment, each collapsible compartment being in fluid communication with its respective cavity a plunger inserted into the fitment, the plunger comprising a head and a neck, wherein the neck is smaller than the head, and a separator that is separate from the fitment and seated on top of the fitment, the separator comprising a comb-like structure with teeth and notches.

13. The device of claim 12, wherein the reduced pressure is the same in each of the cavities, such that each of the cavities are operable to draw a volume of the fluid into each of the cavities upon opening of the seal.

14. The device of claim 12, further comprising means for sealing the fluid in each of the cavities.

15. The device of claim 12, wherein the fitment further comprises a plurality of additional cavities formed therein, each additional cavity having reduced pressure relative to an exterior surface of the fitment, an additional channel fluidly connecting the additional cavities, an additional port extending from the additional channel to the surface of the fitment, an additional seal provided at the additional port, the additional seal configured to maintain the reduced pressure relative to an exterior surface of the fitment in the additional cavities, and further comprising an additional plurality of collapsible compartments affixed to the fitment, each additional collapsible compartment in fluid communication with its respective additional cavity.

16. The device of claim 12, further comprising a plurality of plungers, each plunger inserted into the fitment, each plunger comprising a head and a neck, wherein the neck is smaller than the head, each plunger sized to be received within its respective cavity in the fitment, the plungers operable to force fluid received in the respective cavity from the respective cavity and into the collapsible compartment upon activation.

17. The device of claim 16, further comprising a removable lock operable to engage the plungers and prevent activation of the plungers.

18. The device of claim 12, wherein the channel is etched into the surface of the fitment and the surface of the fitment is covered with a barrier material.

19. The device of claim 18, wherein the seal comprises a punctureable portion of the barrier material.

20. The device of claim 12, wherein the plurality of cavities form a row of cavities, and the fitment further comprises a plurality of additional rows of cavities, each additional cavity having reduced pressure relative to an exterior surface of the fitment prior to opening of the seal, a plurality of additional channels, each additional channel connecting the cavities of its respective row of cavities, a plurality of additional ports, each additional port extending from its respective channel to the surface of the fitment, and a plurality of additional seals, each seal provided at its respective port, each additional seal configured to maintain vacuum in its respective row of additional cavities.

21. The device of claim 20, further comprising a removable cover in contact with an upper edge of each cavity and configured for maintaining the reduced pressure in the cavities, wherein removal of the cover exposes the cavities to surrounding atmosphere.

22. The device of claim 12, wherein at least a portion of each of the plurality of the collapsible compartments is optically clear.

23. The device of claim 12, wherein the cavity has a pressure no greater than 240 Pa.

24. The device of claim 12, wherein the cavity has a pressure no greater than 7 Pa.

25. A device configured to maintain an air-evacuated space therein for drawing a fluid sample into the air-evacuated space, the device comprising a fitment including a vacuum chamber having a reduced pressure, the reduced pressure being below atmospheric pressure relative to an exterior surface of the fitment prior to opening of a frangible seal, a first passageway in communication with the vacuum chamber and configured to communicate with the surrounding atmosphere, and a second passageway in communication with the vacuum chamber and configured to communicate with the surrounding atmosphere, a frangible seal positioned to block the second passageway to prevent communication between the vacuum chamber and the surrounding atmosphere, a flexible compartment coupled to the fitment and formed to define an interior region configured to receive the fluid sample therein, the interior region positioned in fluid communication with the vacuum chamber, a plunger received within the vacuum chamber for movement within the vacuum chamber to adjust a volume of open space unoccupied by the plunger within the vacuum chamber the plunger comprising a head and a neck, wherein the neck is smaller than the head, and a separator that is separate from the fitment and seated on top of the fitment, the separator comprising a comb-like structure with teeth and notches.

26. The device of claim 25, wherein the plunger includes a notch for alignment with the second passageway of the fitment such that rotation of the plunger to offset the notch from the second passageway closes off communication between the vacuum chamber and the second passageway.

27. The device of claim 25, wherein the plunger is movable between a first position to block communication between the vacuum chamber and the first passageway and a second position to block communication between the vacuum chamber and the second passageway.

28. The device of claim 25, wherein the first passageway is less than 1 mm in diameter, the second passageway is less than 1 mm in diameter, and the vacuum chamber is 5 mm in diameter.

* * * * *